US008602948B2

(12) United States Patent
Bohanan

(10) Patent No.: US 8,602,948 B2
(45) Date of Patent: Dec. 10, 2013

(54) APPARATUS AND METHOD FOR EXERCISE

(76) Inventor: Larry H. Bohanan, Knoxville, TN (US)

( * ) Notice: Subject to any disclaimer, the term of this patent is extended or adjusted under 35 U.S.C. 154(b) by 875 days.

(21) Appl. No.: 12/723,028

(22) Filed: Mar. 12, 2010

(65) Prior Publication Data

US 2010/0240506 A1 Sep. 23, 2010

Related U.S. Application Data

(60) Provisional application No. 61/160,875, filed on Mar. 17, 2009.

(51) Int. Cl.
*A63B 21/00* (2006.01)

(52) U.S. Cl.
USPC ..... 482/60; 482/57; 482/62

(58) Field of Classification Search
USPC ..... 482/60, 57, 62; 128/25 B, 25 C, 21, 25 R
See application file for complete search history.

(56) References Cited

U.S. PATENT DOCUMENTS 5,254,060 A 10/1993 Bohanan

*Primary Examiner* — Jerome W Donnelly
(74) *Attorney, Agent, or Firm* — Luedeka Neely Group, P.C.

(57) ABSTRACT

Equipment and methods for exercise of humans are described. An exercise apparatus typically comprises a frame structure that includes a base member that supports a seat with a backrest that can be reclined. There are forward and rear vertical risers that support transverse members. Hooks may be operatively secured to the vertical risers and the transverse members. Generally there is a rotary drive mechanism that moves a left foot cradle and a right foot cradle. There is typically a right hand grip and a left hand grip that are operatively secured to right and left hand cords respectively, and the cords may be operatively secured to the hooks using pulleys. Typically the right hand cord is operatively secured to a right rotary attachment and the left hand cord is operatively secured to a left rotary attachment. Various methods of providing exercise are described using various configurations of the exercise apparatus.

12 Claims, 34 Drawing Sheets

HAND GRIP WITH EYE HOOKS

APPARATUS AND METHOD FOR EXERCISE

CROSS REFERENCES TO RELATED APPLICATIONS

This patent application claims priority from and is related to U.S. Provisional Patent Application Ser. No. 61/160,875 filed 17 Mar. 2009, entitled: Apparatus and Method for Exercise. Provisional Patent Application Ser. No. 61/160,875 is incorporated by reference in its entirety herein.

FIELD

This disclosure relates to the field of human exercise equipment and methods. More particularly, this disclosure relates to exercise equipment that promotes motion of the limbs and torso of persons who have limited mobility.

BACKGROUND

Tens of thousands of persons have debilitated physical conditions that severely restrict or eliminate their ability to exercise. Many such persons receive manual physical therapy treatment to improve their cardio-vascular functions and to reduce muscle atrophy. However, such treatment is time consuming and relies on the availability and ability of physical therapists. What are needed therefore are systems for providing passive and active therapeutic motion for persons that have limited or practically no physical mobility.

SUMMARY

The present disclosure provides various additions to equipment an methods described in the inventor's U.S. Pat. No. 5,254,060 issued Oct. 19, 1993 and incorporated by reference in its entirety herein.

Various embodiments typically involve positioning a person in a seat on an exercise apparatus having a structure with a base member configured to support the seat with a plurality of forward and backward positions and with a backrest having a backrest width and a plurality of reclining positions. There is generally a rear left side vertical riser that is operatively secured to the base member and having rear left "A" through rear left "H" substantially equal-spaced rear left hook attachment positions. There is a rear right side vertical riser operatively secured to the base member and having rear right "A" through rear right "H" substantially equal-spaced rear right hook attachment positions. The rear left side vertical riser and the rear right side vertical riser are generally disposed on opposing sides of the seat and spaced apart at a distance greater than the backrest width. There is typically a forward vertical riser system that is operatively secured to the base member and comprising substantially equal-spaced forward "0" through forward "10" vertical hook attachment positions. Also generally provided is a transverse top left brace that is operatively secured between the forward vertical riser system and the rear left side vertical riser. The transverse top left brace typically includes top left "1" through top left "8" substantially equal-spaced top left hook attachment positions. There is a transverse top right brace operatively secured between the forward vertical riser system and the rear right side vertical riser. The transverse top right brace typically includes top right "1" through top right "8" substantially equal-spaced top right hook attachment positions. Generally there is a forward bottom attachment point operatively secured proximal to the base member. There is a front shock absorber system having a first end with an L-C1 clip and an R-C1 clip operatively secured thereto and a second end operatively secured to the forward vertical riser system. Generally a forward top attachment point is operatively secured to the forward vertical riser system proximal to the transverse top left brace and the transverse top right brace. An L-H4 hook is generally operatively secured to the forward top attachment point and an R-H4 hook is operatively secured to the forward top attachment point. Typically, an L-H5 hook is movably operatively secured to the transverse top left brace and an R-H5 hook is movably operatively secured to the transverse top right brace. An L-H6 hook, an L-H7 hook, an R-H6 hook and an R-H6 hook may be movably operatively secured to the forward vertical riser system. The exercise apparatus typically includes a rotary drive mechanism that is disposed proximal to the forward vertical riser system and that is configured to move a left foot cradle in a left foot forward and reverse rotary motion from a highest left foot position to a lowest left foot position. The rotary drive mechanism is generally configured to move a right foot cradle in a right foot rotary forward and reverse motion from a highest right foot position to a lowest right foot position. The left foot cradle typically has a left rotary attachment and the right foot cradle typically has a right rotary attachment. Generally there is a left arm motion cable that has a left cord with a first end with an L-C2 clip and a second end and with an L-C3 clip and a left hand grip operatively secured to the L-C3 clip. The left arm motion cable also generally has a first left pulley that is normally operatively secured to the L-H4 hook, a second left pulley that is normally operatively secured to the left rotary attachment, and a third left pulley that is normally operatively secured to the L-H5 hook. The first, second and third left pulleys are generally movably operatively secured to the left cord between the first end and the second end. Typically there is a left cord tensioner. Also generally provided is a right arm motion cable that has a right cord with a first end with an R-C2 clip and a second end with an R-C3 clip. A right hand grip is normally operatively secured to the to the R-C3 clip and a first right pulley is normally operatively secured to the R-H4 hook, a second right pulley is normally operatively secured to the right rotary attachment, and a third right pulley is normally operatively secured to the R-H5 hook. The first, second and third right pulleys are generally movably operatively secured to the right cord between the first end and the second end. Typically there is a right cord tensioner. Various methods of providing exercise are provided using various configurations of the elements of the exercise apparatus.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of equipment and methods for providing passive and active exercise for a person. It is to be understood that other embodiments may be utilized, and that structural changes may be made and processes may vary in other embodiments.

Figures 1, 2:
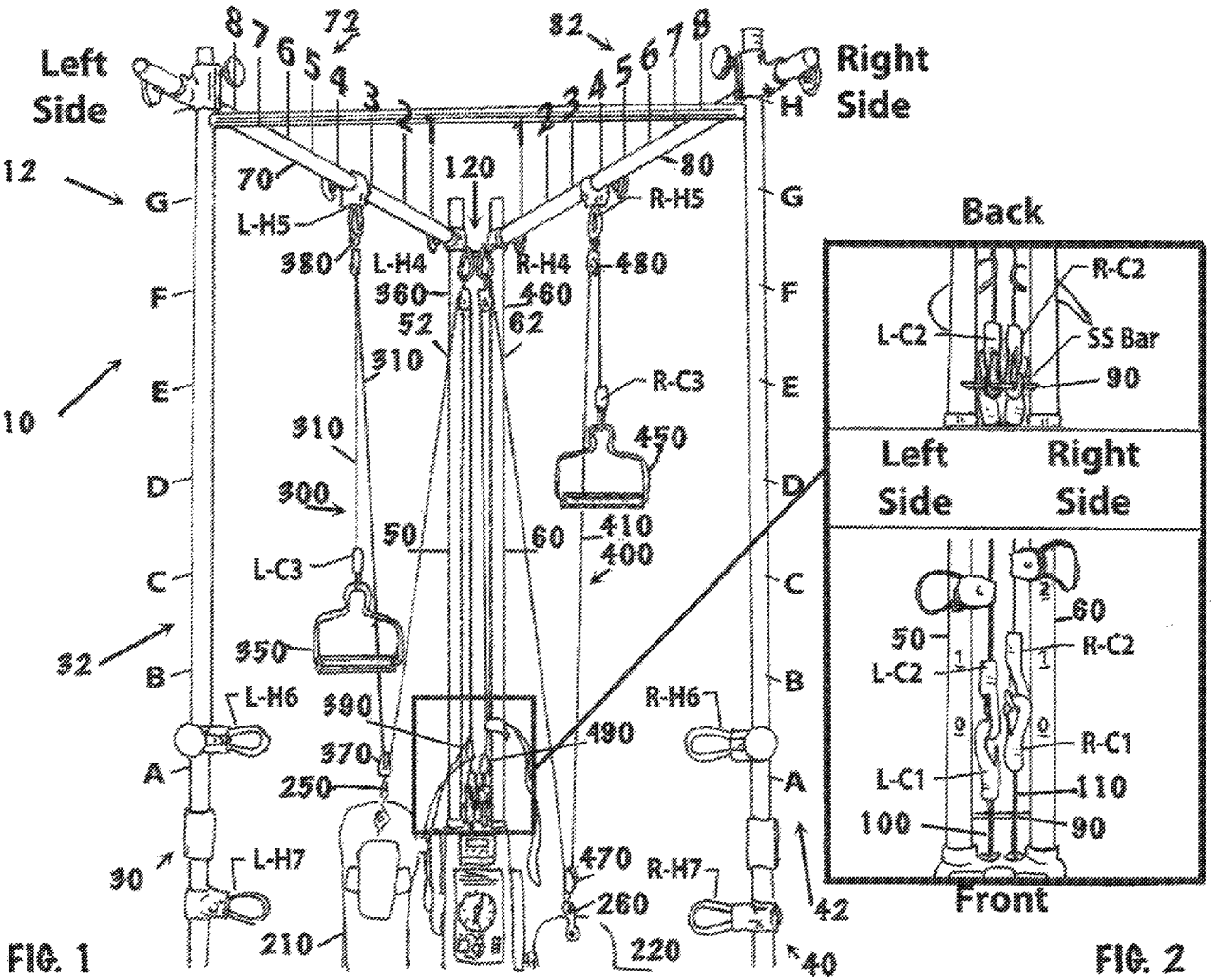
FIG. 1 is a somewhat perspective view of portions of an exercise apparatus.
FIG. 2 is a close-up end elevation view of portions of an exercise apparatus.
Figure 3:
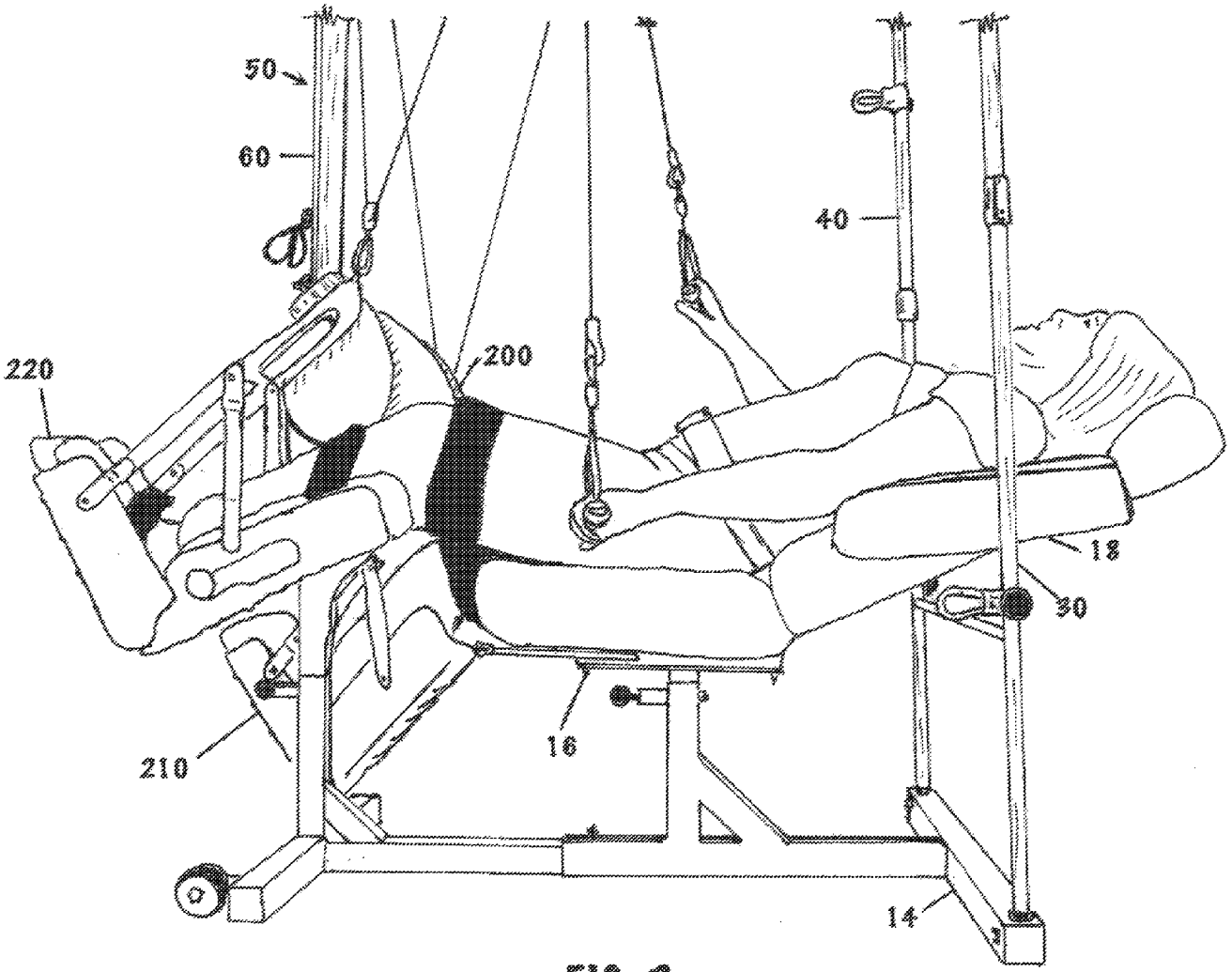
FIG. 3 is a side elevation view of portions of an exercise apparatus.

One embodiment of an exercise apparatus 10 is illustrated in FIGS. 1, 2 and 3. In some applications the exercise apparatus 10 is substantially a passive exercise device, in that the exercise apparatus uses motorized components to cause a person's limbs and torso to move. This movement enhances the person's respiratory, circulatory, and neurological functions. However in many applications the person's own muscular system assists or replaces the motorized action and consequently the exercise apparatus is then partially or solely an active exercise apparatus. In general, the equipment and methods described herein employ an exercise apparatus that may include some or all of the following elements. There generally is a frame structure 12 with a base member 14 (shown in FIG. 2) disposed on a floor and configured to support a seat 16 with a plurality of forward and backward positions and with a backrest 18 having a backrest width and a plurality of reclining positions. A seat belt may be provided. There is a rear left side vertical riser 30 that is operatively secured to the base member 14 and that includes rear left "A" through rear left "H" substantially equal-spaced rear left hook attachment positions 32. As used herein, the term "operatively secured" refers to an arrangement of the recited elements that establishes a structural connection between the recited elements, either by direct attachment of the elements together or by connection of the recited elements through one or more intervening elements. Elements that are operatively secured may move with respect to each other unless they are also described as rigidly secured to each other.

There is a rear right side vertical riser 40 that is operatively secured to the base member and comprising rear right "A" through rear right "H" substantially equal-spaced rear right forward hook attachment positions 42. The rear left side vertical riser 30 and the rear right side vertical riser 40 are examples of a rear vertical riser system. The rear left side vertical riser 30 and the rear right side vertical riser 40 are disposed on opposing sides of the seat 16 and spaced apart at a distance greater than the backrest width. There is a forward left side vertical riser 50 that is operatively secured to the base member 14 and that comprises substantially equal-spaced forward left "0" through forward left "10" vertical hook attachment positions 52. There is a forward right side vertical riser 60 that is operatively secured to the base member 14 and that comprises substantially equal-spaced forward right "0" through forward right "10" vertical hook attachment positions 62. The forward left side vertical riser 50 and the forward right side vertical riser 60 are examples of a forward vertical riser system. In some embodiments the forward vertical riser system may include only one vertical member instead of a left and right vertical member, and typically the forward vertical riser system has forward "0" through forward "10" vertical hook attachment positions.

There is a transverse top left brace 70 that is operatively secured between the forward vertical riser system (in this embodiment the left side vertical riser 50) and the rear left side vertical riser 30. There are top left "1" through top left "8" substantially equal-spaced top left hook attachment positions 72. There is a transverse top right brace 80 that is operatively secured between the forward vertical riser system (in this embodiment between the forward right side vertical riser 60) and the rear right side vertical riser 40. There are top right "1" through top right "8" substantially equal-spaced top right hook attachment positions 82. In most embodiments the transverse top left brace 70 and the transverse top right brace 80 are disposed at an elevation that is above the uppermost portion of the backrest 18 in it most upward of reclining positions. Typically the transverse top left brace 70 and the transverse top right brace 80 are disposed at an elevation of at least five and preferably at least six feet above the floor. That five or six foot elevation provides improved geometry for exercise patterns that extend a person's hands above their head when they are seated on the seat 16.

There is a forward bottom attachment point 90 that is operatively secured to the forward vertical riser system (in this embodiment, between the forward left side vertical riser 50 and the forward right side vertical riser 60) proximal to the base member. As shown in FIG. 2 there is a front left shock absorber 100 having a first end with a clip labeled L-C1 operatively secured thereto and a second end operatively secured to the forward vertical riser system (in this embodiment, to the forward left side vertical riser 50). There is a front right shock absorber 110 having a first end with a clip labeled R-C2 operatively secured thereto and a second end operatively secured to the forward vertical riser system (in this embodiment, to the forward right side vertical riser 60). The front left shock absorber 100 and the front right shock absorber 110 are typically fabricated from short segments of bungee cords. The front left shock absorber 100 and the front right shock absorber 110 are examples of a font shock absorber system. In some embodiments the front shock absorber system may be fabricated as a single shock absorber. There is a forward top attachment point 120 operatively secured to the forward vertical riser system (in this embodiment, operatively secured to the forward left side vertical riser 50 and the forward right side vertical riser 60) proximal to the transverse top left brace 70 and the transverse top right brace 80.

There is a hook labeled L-H4 that is operatively secured to the forward top attachment point 100 and a hook labeled R-H4 that is operatively secured to the forward top attachment point 120. There is a hook labeled L-H5 that is movably operatively secured to the transverse top left brace 70. There is a hook labeled R-H5 that is movably operatively secured to the transverse top right brace 80. There is a hook labeled L-H6 that is movably operatively secured to the rear left side vertical riser 30 and there is a hook labeled L-H7 that is movably operatively secured to the rear left side vertical riser 30. There is a hook labeled R-H6 that is movably operatively secured to the rear right side vertical riser 40. There is a hook labeled R-H7 that is movably operatively secured to the rear right side vertical riser 40.

As best seen in FIG. 3 there is a rotary drive mechanism 200 that is disposed proximal to the forward left side vertical riser 50 and the forward right side vertical riser 60. The rotary drive mechanism 200 has a variable speed motor with a gearing system that may be adjusted to an output speed that may be from about one cycle per two seconds to about two cycles per second. In the embodiment of FIG. 3 the rotary drive mechanism 200 is configured to move a left foot cradle 210 in a left foot forward and reverse rotary motion from a highest left foot position to a lowest left foot position. The rotary drive mechanism is further configured to move a right foot cradle 220 in a right foot rotary forward and reverse motion from a highest right foot position to a lowest right foot position. The rotary motions may be generally circular or generally elliptical and may traverse portions of circles or portions of ellipses and may traverse full circular or full elliptical paths. As best seen in FIG. 1, the left foot cradle 210 has a left rotary attachment 250 and the right foot cradle 220 has a right rotary attachment 260. In some embodiments the foot cradles 210 and 220 are not employed to support a person's foot or feet who using the exercise apparatus 10, and in some of these embodiments the function of the rotary drive mechanism 200 is to move the left rotary attachment 250 and the right rotary attachment 260 in a rotary motion pattern. Some embodiments do not incorporate a left foot cradle 210 or a right foot cradle 220, and the rotary drive mechanism is configured to directly move a left rotary attachment and a right rotary attachment (equivalent to the left rotary attachment 250 and the right rotary attachment 260 without the associated foot cradles) in a rotary motion.

Continuing with FIG. 1, there is a left arm motion cable 300 having a left cord 310 having a first end with a clip labeled L-C2 (FIG. 2) and a second end with a clip labeled L-C3. There is a left hand grip 350 that is operatively secured to the clip L-C3. There is a first left pulley 360 that is normally operatively secured to the hook labeled L-H4, and a second left pulley normally 370 that is operatively secured to the left rotary attachment 250, and a third left pulley 380 that is normally operatively secured to the hook labeled L-H5. The first, second and third left pulleys (360, 370, and 380) are movably operatively secured to the left cord 310 between the first end and the second end. There is a left cord tensioner 390. A cord tensioner is a device that acts as a clamp to take up a varying amount of slack in a cord.

There is a right arm motion cable 400 that has a right cord 410 having a first end with a clip labeled R-C2 (FIG. 2) and a second end with a clip labeled R-C3. There is a right hand grip 450 that is normally operatively secured to the to clip labeled R-C3 clip. There is a first right pulley 460 that is normally operatively secured to the R-H4 hook, and a second right pulley 470 that is normally operatively secured to the right rotary attachment 260, and a third right pulley 480 that is normally operatively secured to the hook labeled R-H5. The first, second and third right pulleys (460, 470, and 480) are movably operatively secured to the right cord 410 between the first end and the second end. There is a right cord tensioner 490.

Various methods of configuring and using the exercise apparatus 10 are described in the "Instruction Manual" appended to this specification and incorporated in its entirety herein.

Various methods of configuring and using the exercise apparatus 10 are illustrated by the following descriptions.

Figure 4:
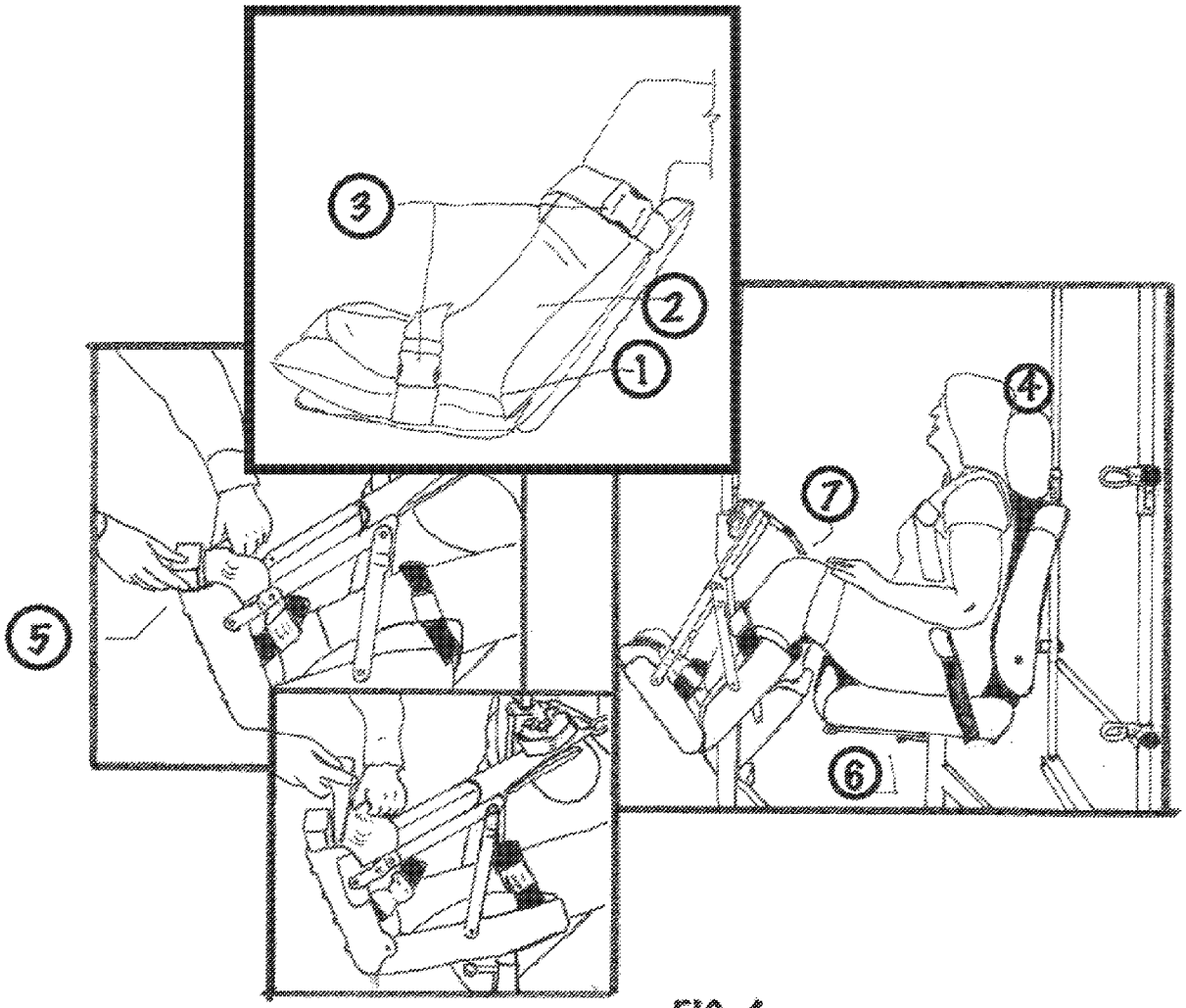
FIG. 4 presents several views of the setup of an exercise apparatus for ankle dorsiflexion exercise.

Ankle Dorsiflexion (See FIG. 4 and follow instructions for each setup of foot cradle. The circled numbers in FIG. 4 correspond to the following instructions.)

1. Be sure heal is in pocket.
2. Wear socks.
3. Buckles should be firm not tight.

To Increase Dorsiflexion:

4. Chair Position: Upright.
5. Insert foam wedge under boot.
6. Slide seat forward as needed.
7. Direction: Forward & Reverse.

Figure 5:
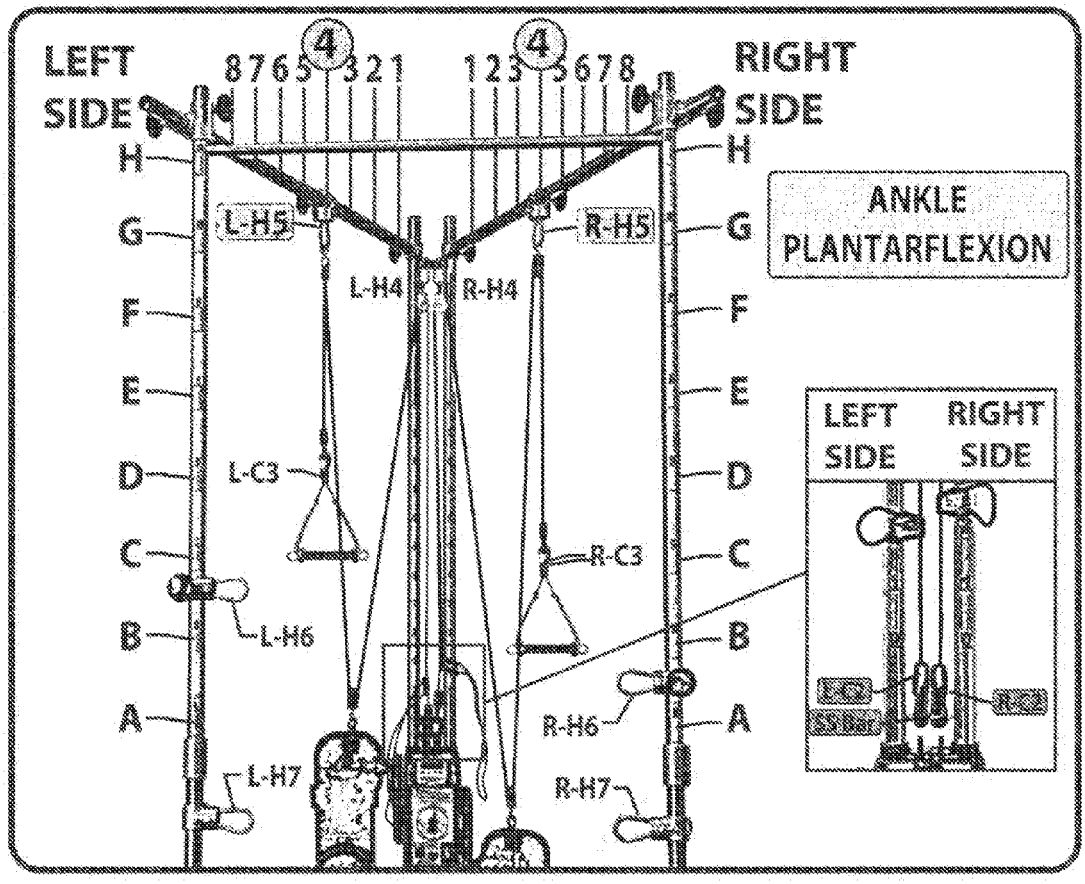
FIG. 5 presents a rear elevation view of the setup of an exercise apparatus for ankle plantarflexion exercise.

Ankle plantarflexion (Ref. FIG. 5)

To Increase Plantarflexion:

1. Chair Position: Fully Reclined.
2. Remove foam wedges under boots.
3. Slide seat forward.
4. Keep legs straight.
5. Direction of rotary drive mechanism: Forward &Reverse.

Caution: Those with low back injury and congestive heart failure have difficulty with flat positions. Keep chair slightly reclined or use pillows.

Figure 6:
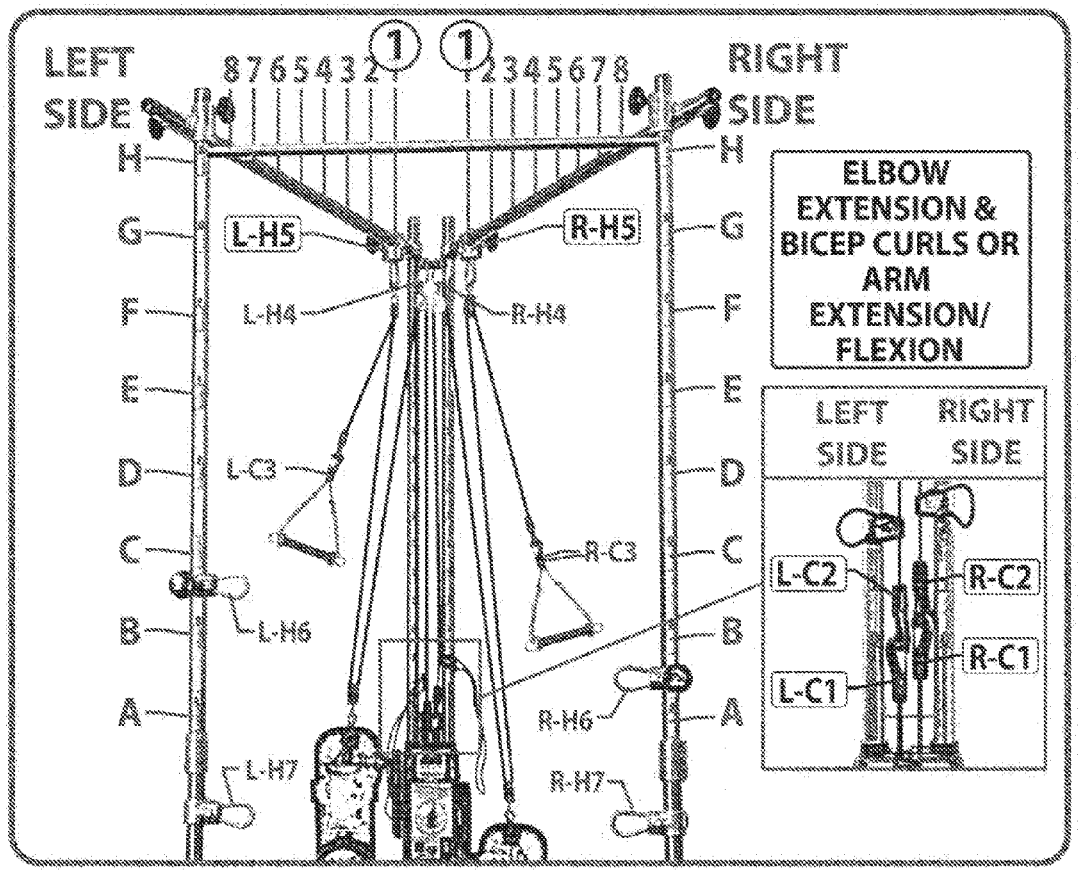
FIG. 6 presents a rear elevation view of the setup of an exercise apparatus for improving elbow extension and performing bicep curls.

Elbow Extension & Bicep Curls (Ref. FIG. 6)

1. Chair Position: Partially Reclined.
2. Move L-H5 and R-H5 to #1 position on the transverse top left brace and the transverse top right brace.
3. L-C2 and R-C2 are connected to L-C1 and R-C1, adjust tension as needed.
4. For elbow extension allow for full stretch.
5. For bicep curls, pull hand grips toward you and keep elbows up.

The configuration of FIG. 6 may also be used for ARM EXTENSION/FLEXION.

Figure 7:
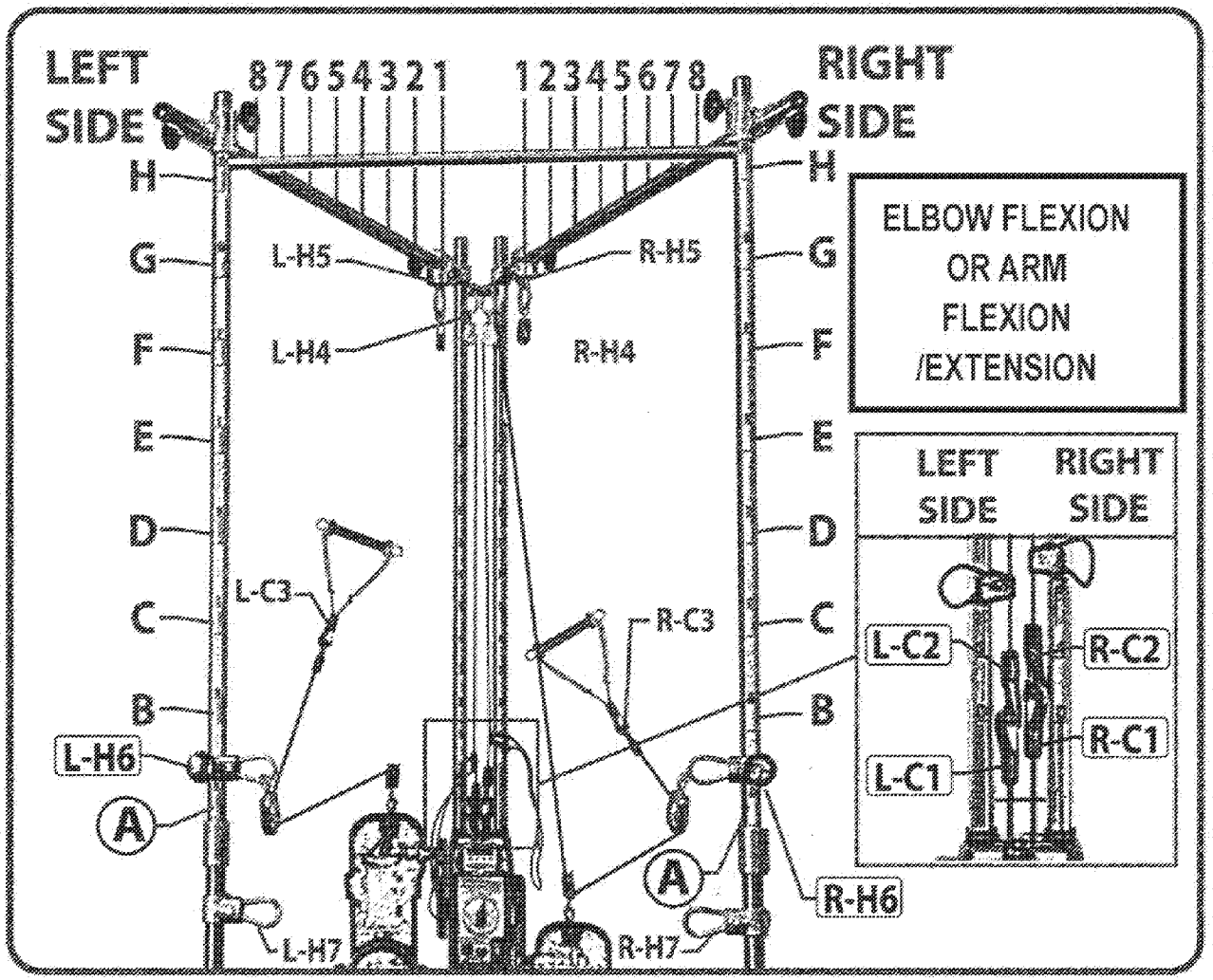
FIG. 7 presents a rear elevation view of the setup of an exercise apparatus for elbow flexion exercise.

Elbow Flexion (Ref. FIG. 7)

To Increase Flexion:

1. Chair Position: Partially Reclined.

2. Remove pulleys from L-H5 & R-H5 and fasten them to L-H6 & R-H6. The terms "removable" and "removably" are used herein in reference to components that may be removed from other components.

3. Slide L-H6 & R-H6 to position "A" on rear left vertical riser and rear right vertical riser and tighten slack in cords.

4. L-C2 and R-C2 are connected to L-C1 and R-C1.

5. Support the elbows on the arm rest, palms facing you.

6. Pull hand grips away from your body.

The configuration of FIG. 7 may also be used for ARM FLEXION/EXTENSION/

Hip Extension

To Increase Extension:

1. Chair Position: Fully Reclined.

2. Position L-H5 & R-H5 to position #5 on the transverse top left brace and the transverse top right brace, or directly above hands.

3. Slide seat forward as needed.

4. Palms face the floor.

5. L-C2 and R-C2 are connected to L-C1 and R-C1.

6. Strap abduction wedge between thighs if needed for stability.

Caution: Those with low back injury and congestive heart failure have difficulty with flat positions. Keep chair slightly reclined or use pillows.

Hip Flexion

To Increase Flexion:

1. Chair Position: Straight up.

2. Slide seat forward.

3. Lower seat height and raise the rotary drive mechanism as needed.

4. Fasten seat belts (lower belt holds pelvis in place).

5. Use abduction wedge if needed.

6. Direction of rotary drive mechanism: Forward &Reverse.

Knee Extension

To Increase Extension:

1. Chair Position: Upright to slightly reclined.

2. Slide seat back.

3. Raise seat height and lower the rotary drive mechanism as needed.

4. Fasten seat belts (lower belt holds pelvis in place).

5. Use abduction wedge if needed.

6. Direction of rotary drive mechanism: Forward &Reverse.

While exercise apparatus is in motion apply gentle manual pressure proximal-distal to the knee joint for increased extension.

Knee Flexion

To Increase Flexion:

1. Chair Position: Upright 1 slightly reclined.

2. Hook one of the extra bungee cords from under the heel of the foot cradle to the back of the ¼" plate under the seat.

3. Lower seat height for more knee flexion.

4. Fasten seat belts (lower belt holds pelvis in place).

5. Use foam foot wedge for more dorsiflexion.

6. Direction of rotary drive mechanism: Forward & Reverse.

Caution: Stop machine before applying bungee cords. Slowly rotate through one full cycle prior to increasing the speed.

Figure 8:
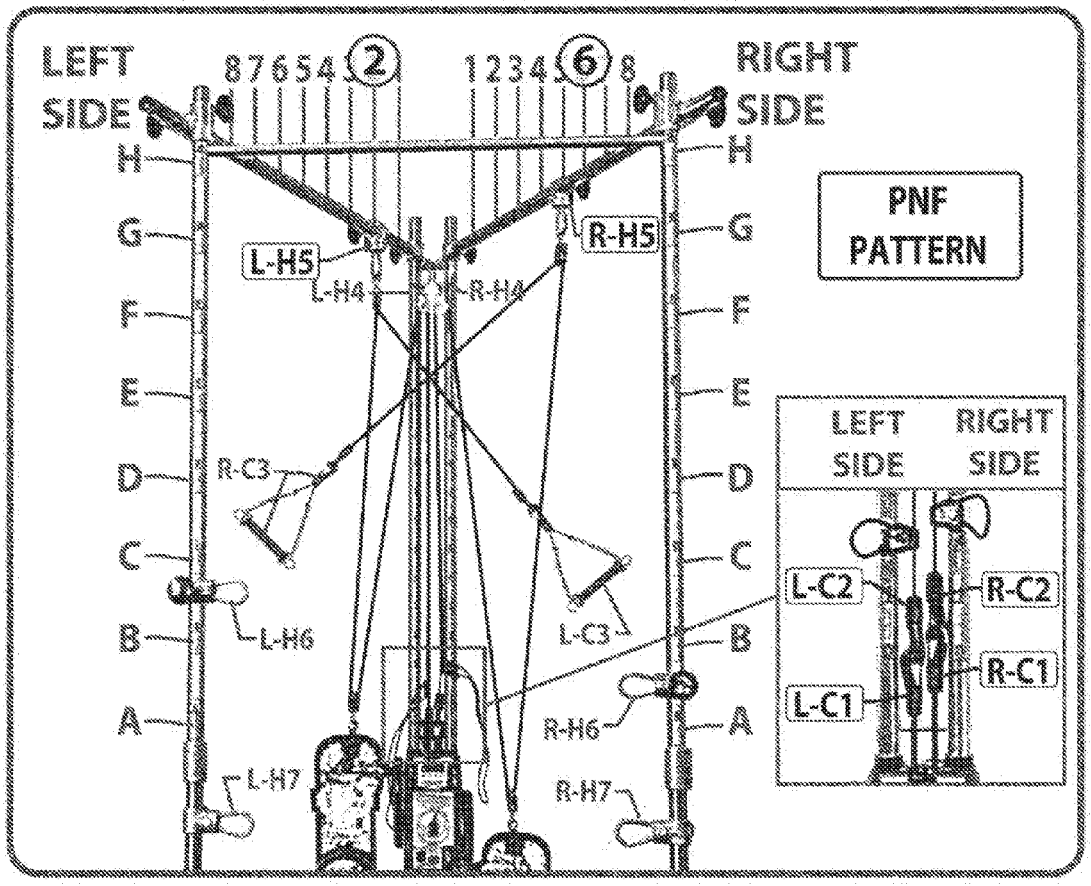
FIG. 8 presents a rear elevation view of the setup of an exercise apparatus for Proprioceptive Neuromuscular Facilitation exercise.

Proprioceptive Neuromuscular Facilitation (PNF) Pattern (Ref. FIG. 8)

To Increase Arm Extension:

1. Chair Position: Upright to slightly reclined.

2. Have user grasp hand grips with the opposite hands, right hand to left grip and left hand to right grip.

3. Position L-H4 at #2 on the transverse top left brace and R-H4 to the #6 position on the transverse top right brace.

4. Gradually tighten cords to increase range of motion.

5. L-C2 and R-C2 are connected to L-C1 and R-C1.

6. If hand is contracted hook a small bungee cord from the forward bottom attachment point to a small eye hook on the hand grip.

Figure 9A:
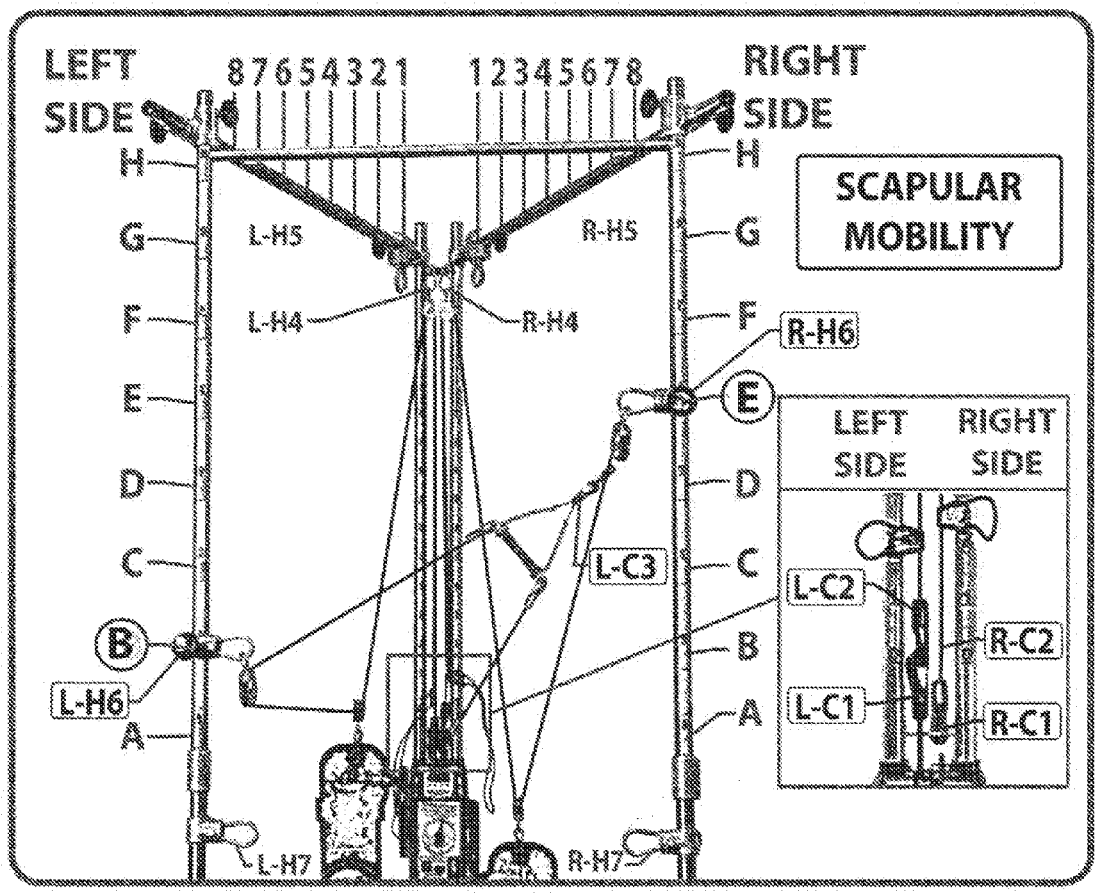
FIGS. 9A, 9B, and 9C present rear elevation views of the setup of an exercise apparatus for scapular mobility exercise.
Figure 9B:
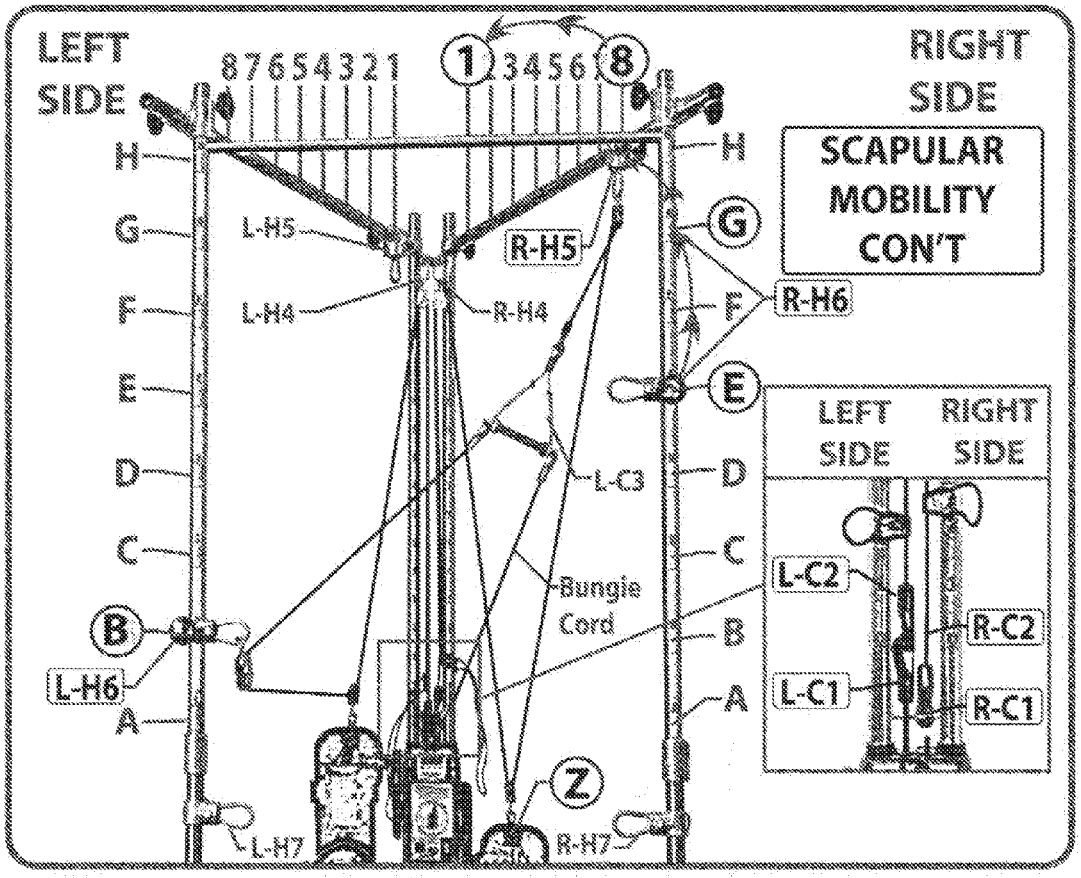
Figure 9C:
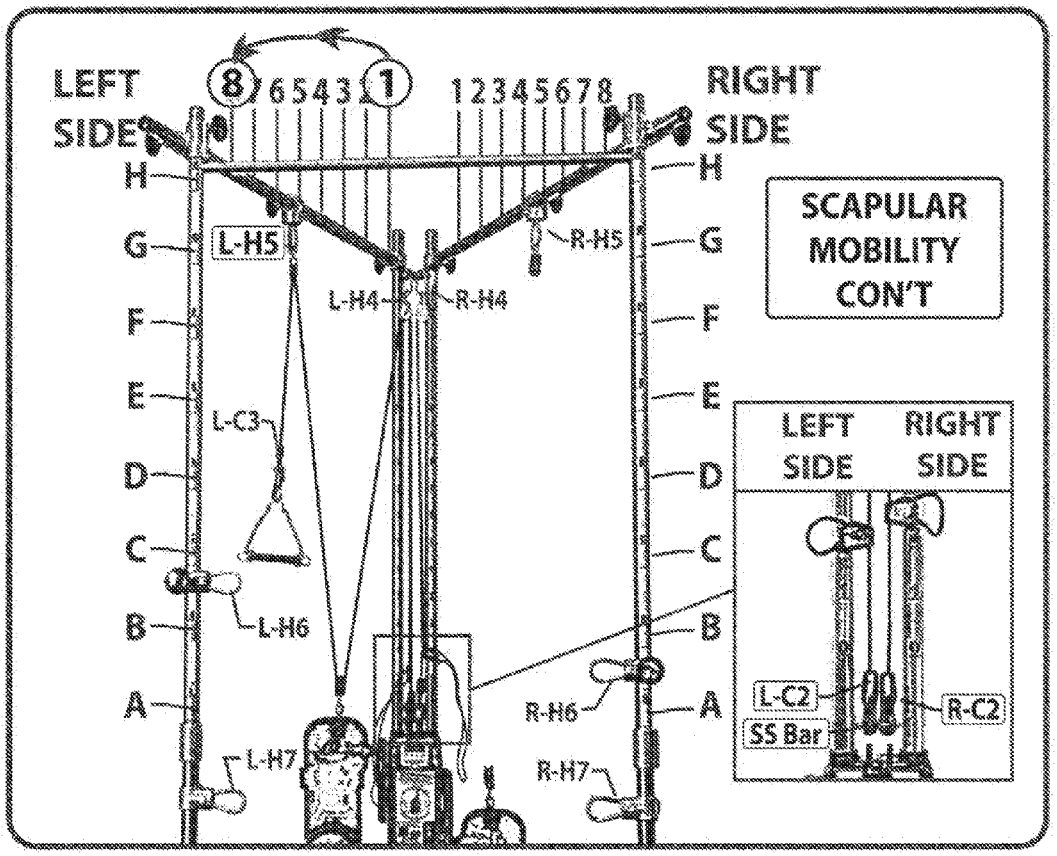

Scapular Mobility (Ref. FIGS. 9A, 9B, and 9C)

1. Chair Position: Partially reclined 2. Disconnect pulley from L-H5 and attach it to L-H6, position it at "B". Remove both firm hand grips. Connect L-C2 to L-C1.

3. Disconnect pulley from R-H5 and connect it to R-H6, position "E". Connect L-C3 to a soft hand grip. Connect L-C3 to the eye hook on soft hand grip nearest patient. Connect R-C2 to the forward bottom attachment point and remove all slack from that cord.

4. Attach one end of a bungee cord to the forward bottom attachment point and the other end to the other eye hook of the soft hand grip. This will ensure the soft hand grip doesn't come in contact with the patient. You may need to recline the seat more if needed (while supporting it).

5. Slowly work the contracted limb, gradually moving R-H6 up the rear right vertical riser from "E" in small interval, towards "G", or as far as the limb will allow comfortably. Tighten the cord about an inch at a time (when the arm comes down) as the user progresses.

6. Once the limb is stretched, make sure to release all the tension in the cord before you disconnect the pulley from R-H6 and connect it to R-H5 at position "8" on the rear right vertical riser. Be sure the foot cradle on the patients right side has rotated to the lowest position "Z". This allows adjustment to the tension in the cord accordingly. The arm will be at its highest point when the foot cradle is at its lowest point "Z". As the user progresses move R-H5 from position "8" towards position "1" on the transverse top right brace in small intervals. When you reach "1" position proceed to the next step.

7. Next, release tension out of cord and then disconnect all clips. Remove the extra bungee completely and slide hooks on the right side fully out of the way. Ensure the foot cradle, now on the left side of the patient is at its lowest point. Disconnect the pulley from L-H6. Connect it to L-H5 at position "1" on the transverse top left brace. Attach L-C3 to the soft hand grip clip. Adjust the tension in the cord so the hand is at its highest.

8. Continue to work out contracture. Slide L-H5 from "1" position towards "8" in small intervals as the use progresses. When this exercise is complete, the contracted limb should be extended above the head or as far as the limb will allow comfortably.

Figure 10:
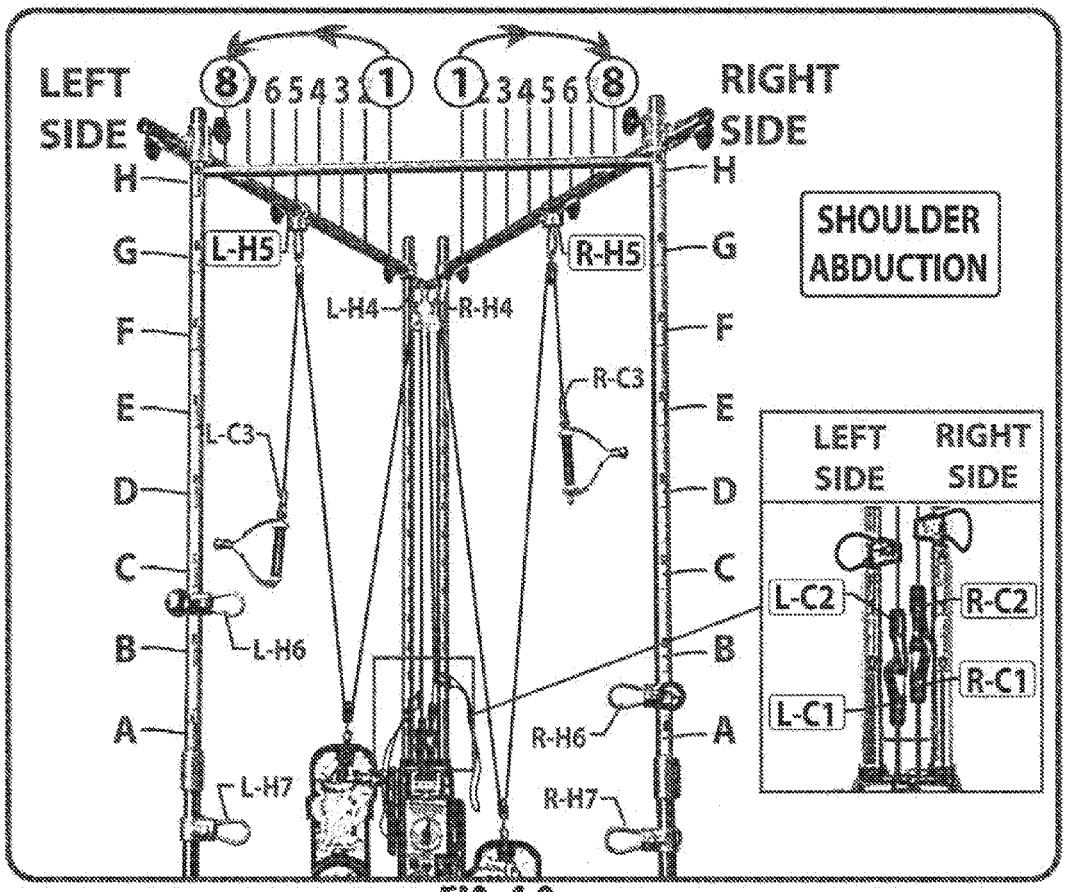
FIG. 10 presents a rear elevation view of the setup of an exercise apparatus shoulder abduction exercise.

Shoulder Abduction (Ref. FIG. 10)

To Increase Abduction:

1. Chair Position: Upright to slightly reclined.

2. Start L-H5 and R-H5 at "1" position on transverse top left brace and the transverse top right brace.

3. Place hands on the hand grips, palms facing out. Tighten cords to increase hand elevation.

4. L-C2 and R-C2 are connected to L-C1 and R-C1.

5. Move L-H5 and R-H5 from "1" towards "8" (scaption range) to work towards pure abduction movement.

Figure 11:
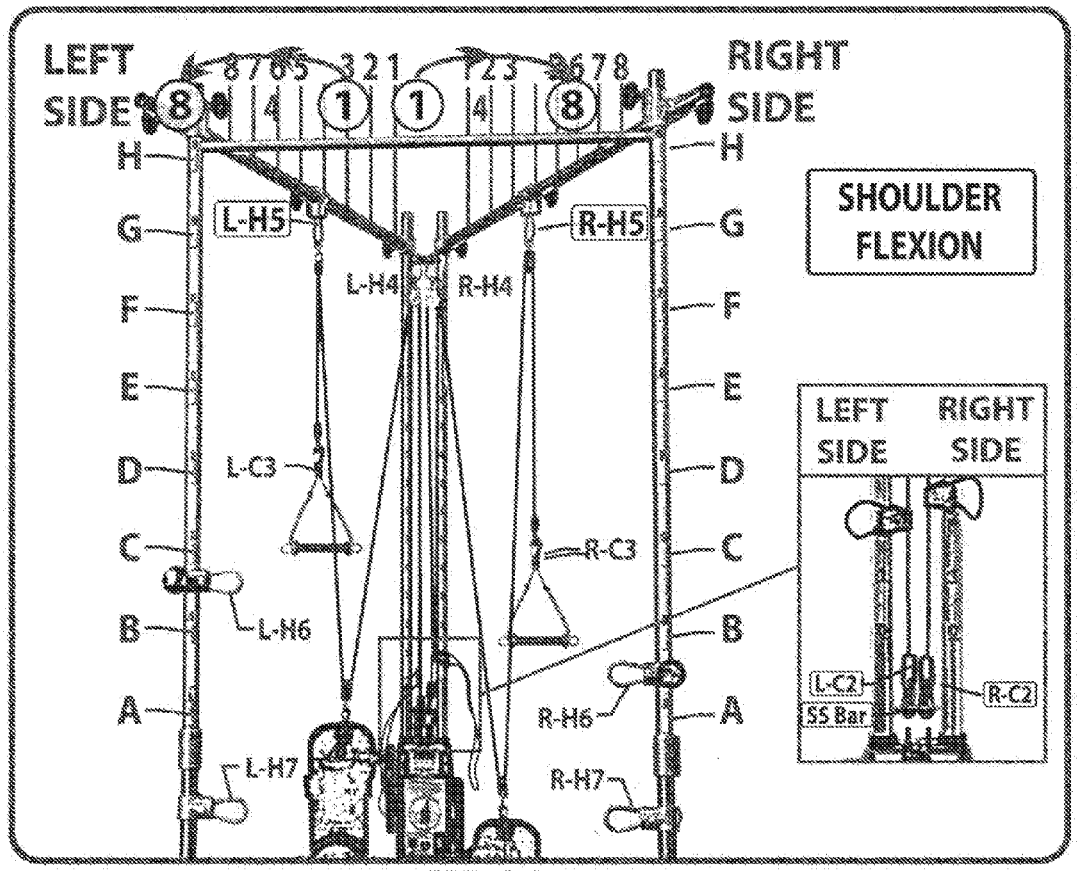
FIG. 11 presents a rear elevation view of the setup of an exercise apparatus for shoulder flexion exercise.

Shoulder Flexion (Ref. FIG. 11)

To Increase Flexion:

1. Chair Position: Upright to slightly reclined.

2. Start L-H5 and R-H5 at "1" position on transverse top left brace and the transverse top right brace.

3. Place hands on the hand grips, palms facing out. Tighten cords to increase hand elevation.

4. L-C2 and R-C2 are connected to L-C1 and R-C1.

5. Move L-H5 and R-H5 from "1" towards "8" as far as the user can tolerate.

Figure 12:
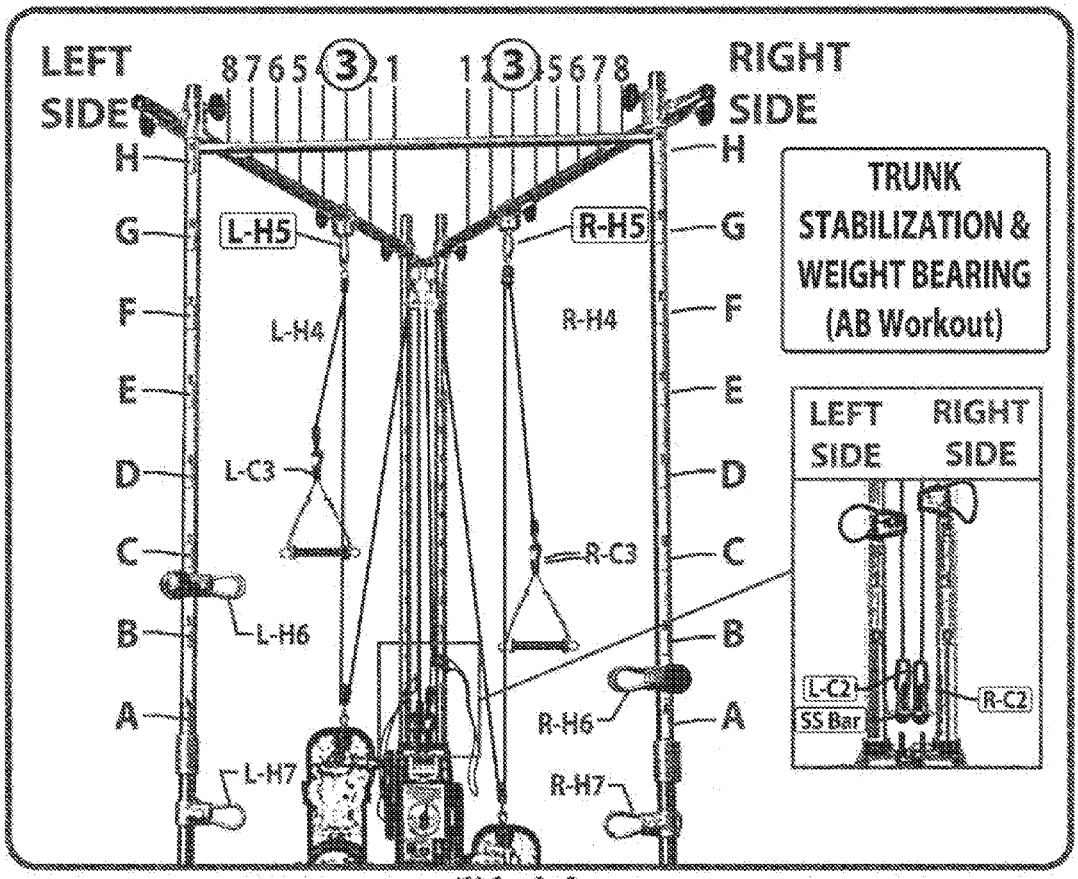
FIG. 12 presents a rear elevation view of the setup of an exercise apparatus for trunk stabilization and weight bearing (abdominal) exercise.

Trunk Stabilization, Weight Bearing & AB Workout (Ref. FIG. 12)

1. Chair Position: Partially reclined.

2. Start L-H5 and R-H5 at "3" position on the transverse top left brace and the transverse top right brace, or up above the patients hands.

3. Place hands on the hand grips, palms facing down.

4. L-C2 and R-C2 are connected to forward bottom attachment point.

5. Raise buttocks by pushing down with the feet, hands, and shoulders. User is to keep buttocks and abdomen muscles tightened throughout the exercise.

Figure 13:
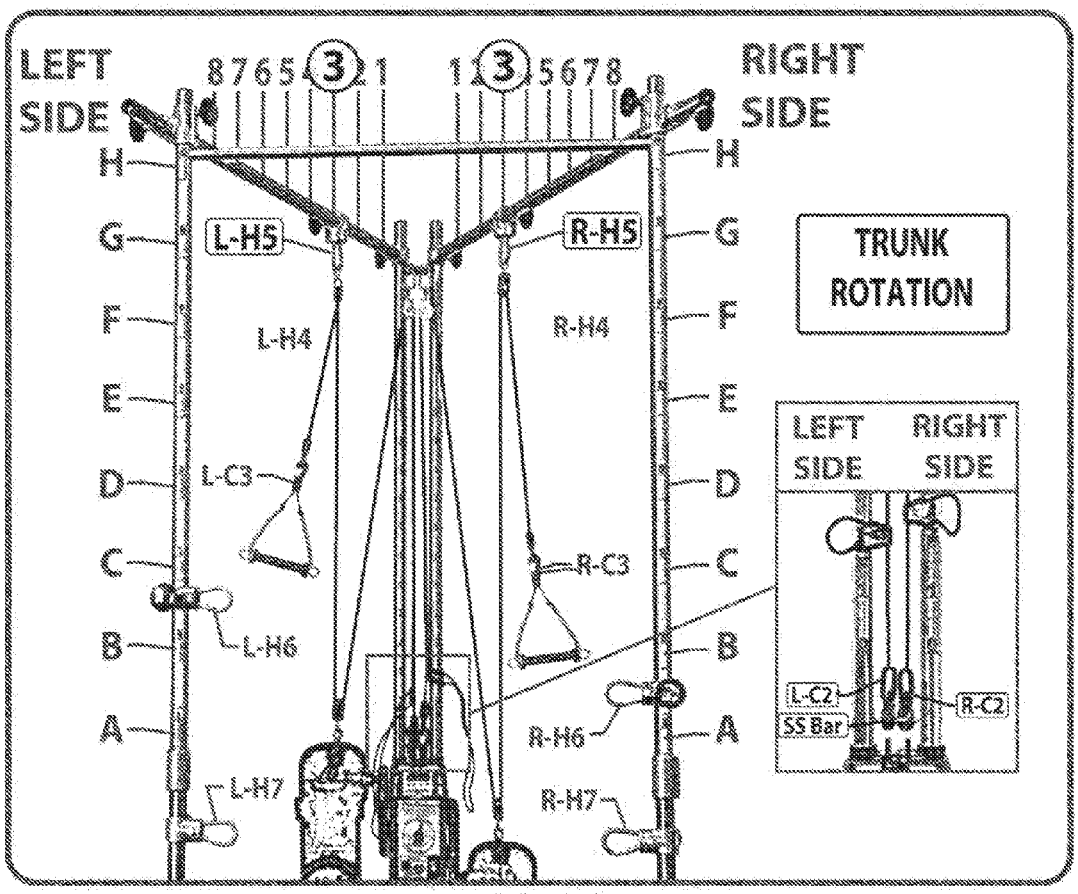
FIG. 13 presents a rear elevation view of the setup of an exercise apparatus for trunk rotation exercise.

Trunk Rotation (Ref. FIG. 13)

1. Chair Position: Partially reclined.

2. Fasten waist belt securely.

3. Do not fasten chest belt.

4. Position L-H5 and R-H5 at "3" on the transverse top left brace and the transverse top right brace.

5. L-C2 and R-C2 are connected to forward bottom attachment point.

6. Increase tension on cords to facilitate trunk rotation.

Figure 14:
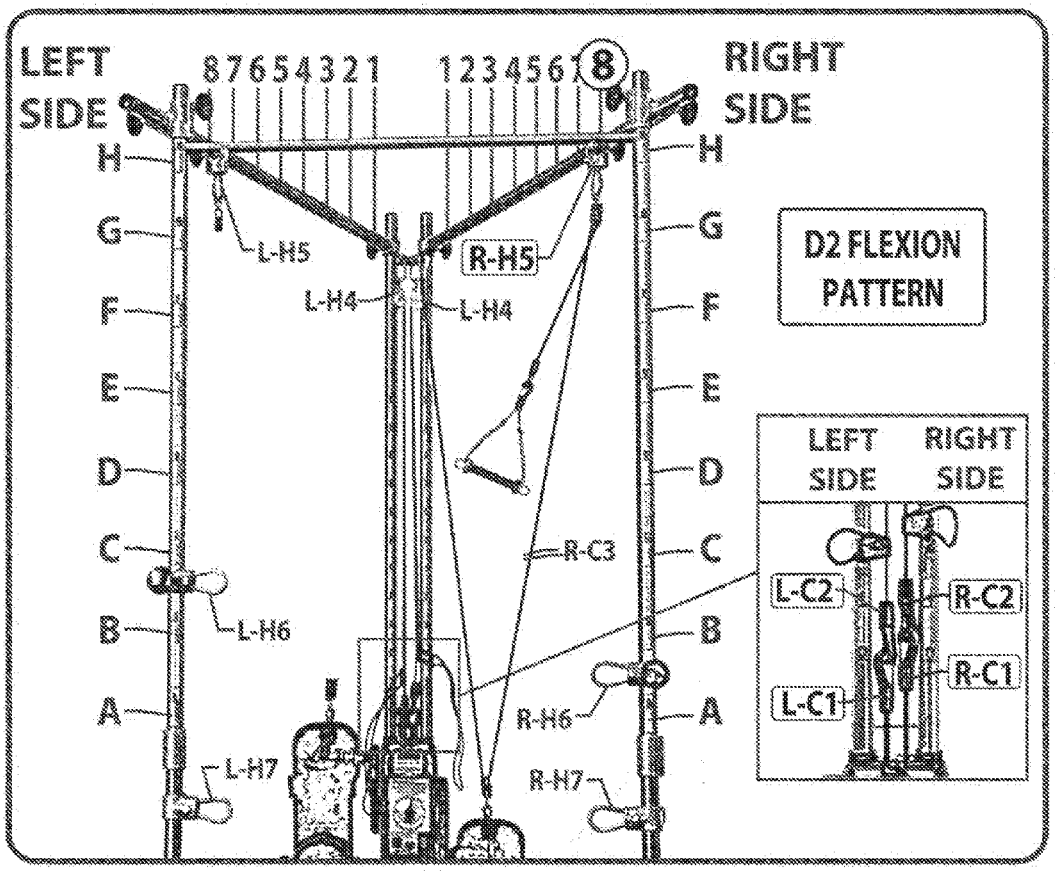
FIG. 14 presents a rear elevation view of the setup of an exercise apparatus for D2 flexion pattern exercise.

D2 Flexion Pattern (Ref. FIG. 14)

1. Chair Position: Upright to slightly reclined.

2. Position L-H5 or R-H5 (which-ever side you're working on) to "8".

3. L-C2 and R-C2 are connected to L-C1 and R-C1.

4. With upper extremity pull down diagonally across the body to the opposite side.

Figure 15:
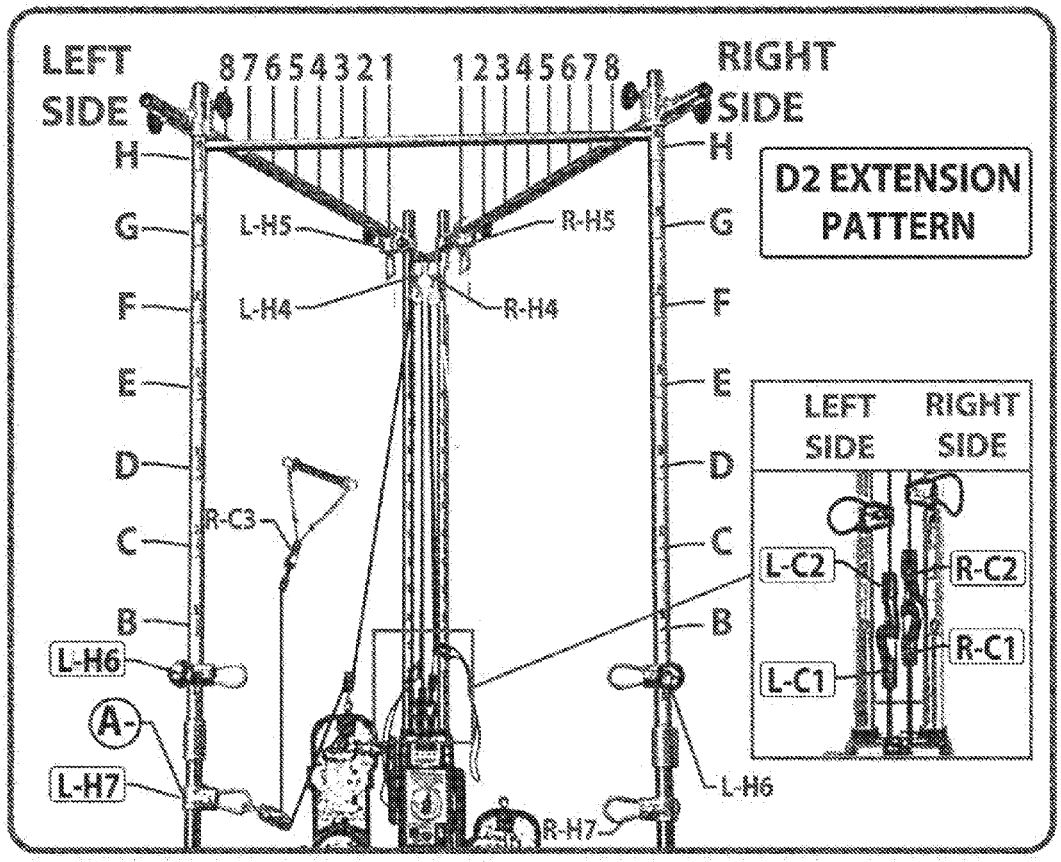
FIG. 15 presents a rear elevation view of the setup of an exercise apparatus for D2 extension pattern exercise.

D2 Extension Pattern (Ref. FIG. 15)

2. Work one side at a time.

3. Disconnect pulley from L-H5 and connect it to L-H7 or L-H6. Slide L-H7 or L-H6 up or down as needed.

4. L-C2 and R-C2 are connected to L-C1 and R-C1, pull tension out of the cord.

5. With opposite hand, try to pull up diagonally across the body (against resistance) while keeping elbow down.

Figure 16:
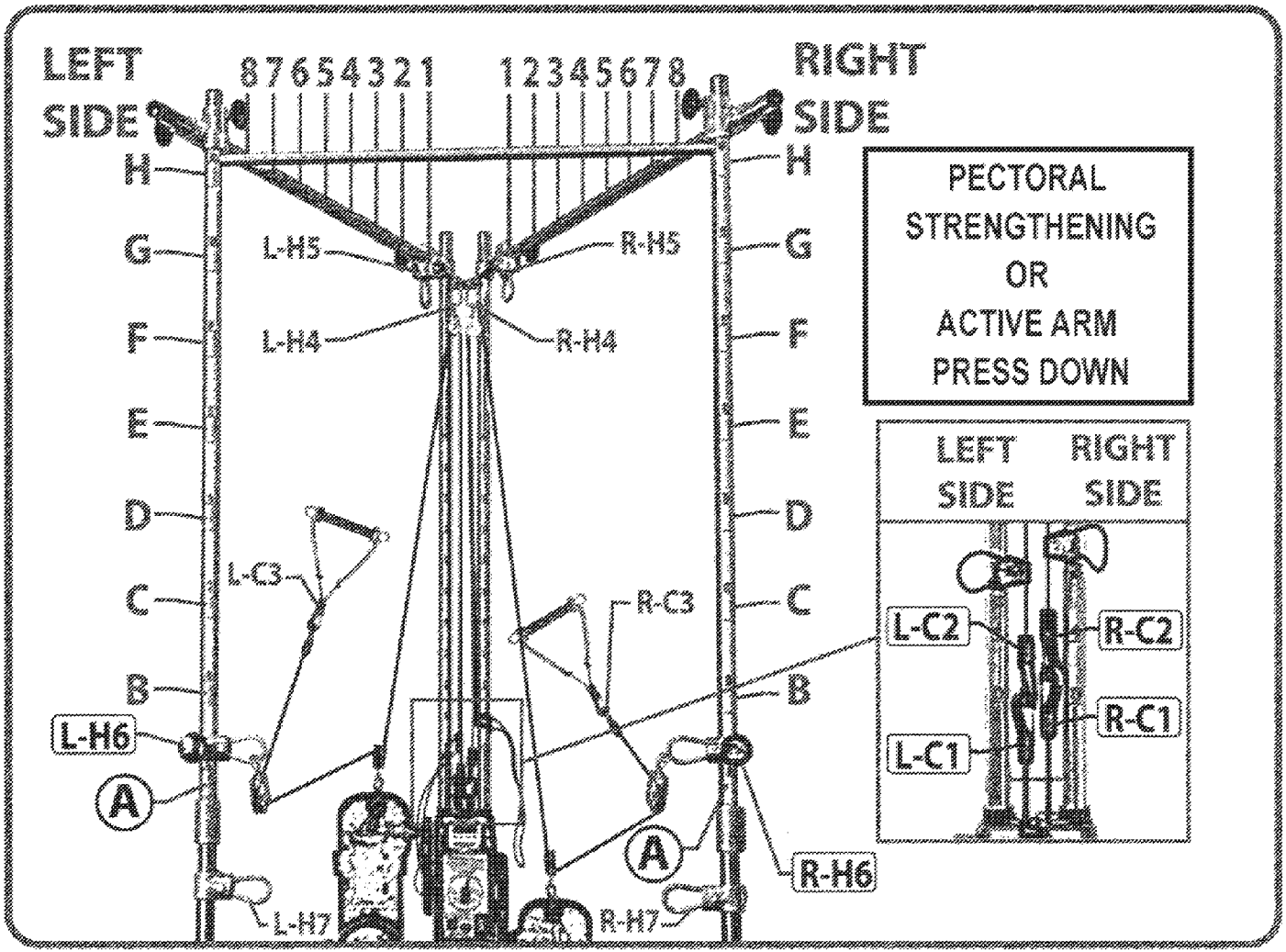
FIG. 16 presents a rear elevation view of the setup of an exercise apparatus for pectoral strengthening exercise.

Pectoral Strengthening (Ref. FIG. 16)

1. Chair Position: Upright to slightly reclined.

2. Disconnect pulley from L-H5 and R-H5 and connect it to L-H6 and R-H6, slide to position "A."

3. L-C2 and R-C2 are connected to L-C1 and R-C1.

4. Leave the rotary drive mechanism off where both foot cradles are at the same height.

5. Begin 90% abduction and progress to 90% horizontal abduction, working on the pectorals.

The configuration of FIG. 16 may also be used for ACTIVE ARM PRESSDOWN.

Figure 17:
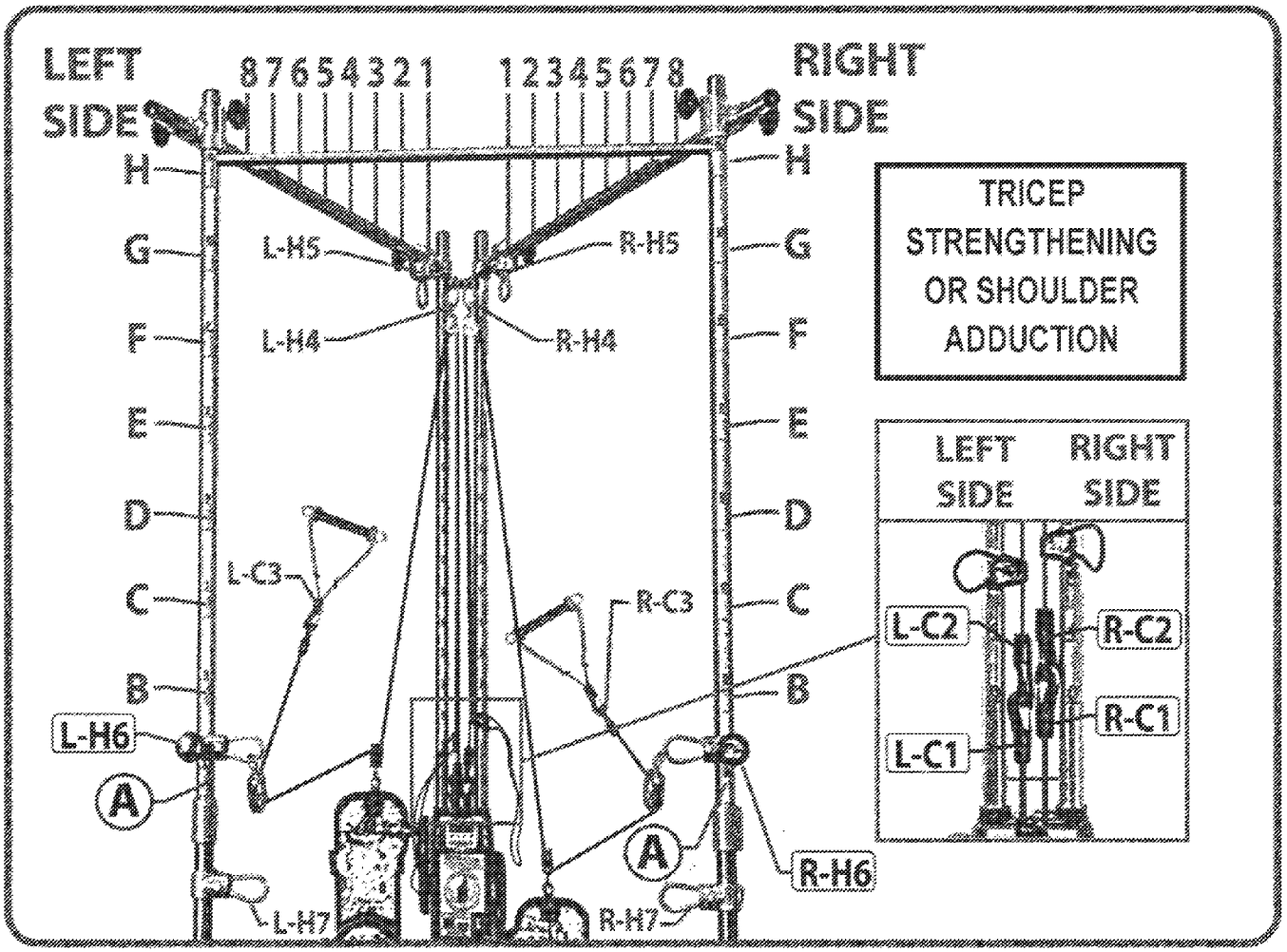
FIG. 17 presents a rear elevation view of the setup of an exercise apparatus for tricep strengthening exercise.

Tricep Strengthening (Ref. FIG. 17)

1. Chair Position: Upright to slightly reclined.

2. Disconnect pulley from L-H5 and R-H6 and connect to L-H6 and R-H6, slide to position "A".

3. L-C2 and R-C2 are connected to L-C1 and R-C1, palms are in handgrips facing down.

4. Leave the rotary drive mechanism off where both foot cradles are at the same height.

5. Begin 90% elbow flexion and progress through until elbows are fully extended, working on the triceps.

The configuration of FIG. 17 may also be used for SHOULDER ABDUCTION.

Figure 18:
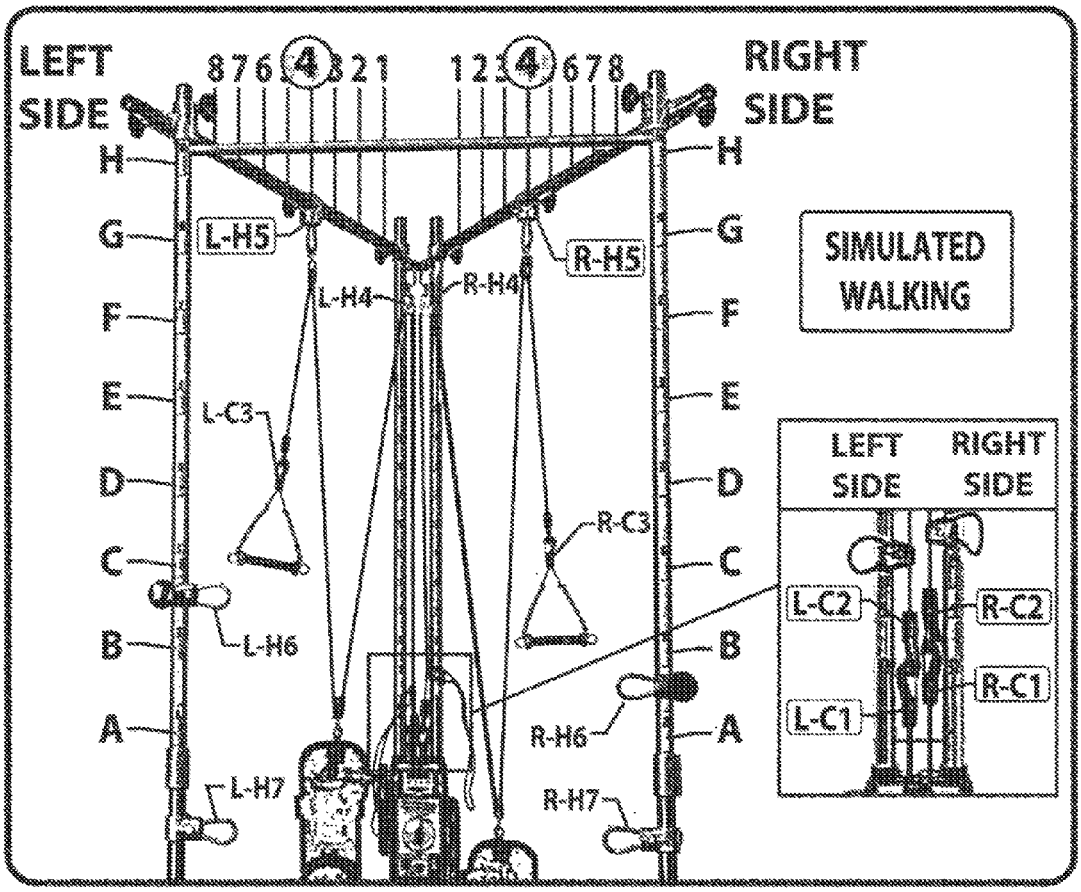
FIG. 18 presents a rear elevation view of the setup of an exercise apparatus for simulated walking exercise.

Simulated Walking (Ref. FIG. 18)

To Simulate Walking:

1. Chair Position: Should be reclined at 10 to 15 degrees.

2. Position L-H5 & R-H5 to position #4 on the transverse top left brace and the transverse top right brace, or directly above hands.

3. Slide seat forward or backward as needed.

4. Strap abduction wedge between thighs if needed for stability.

5. Palms face the floor.

6. L-C2 and R-C2 are connected to L-C1 and R-C1.

Figure 19:
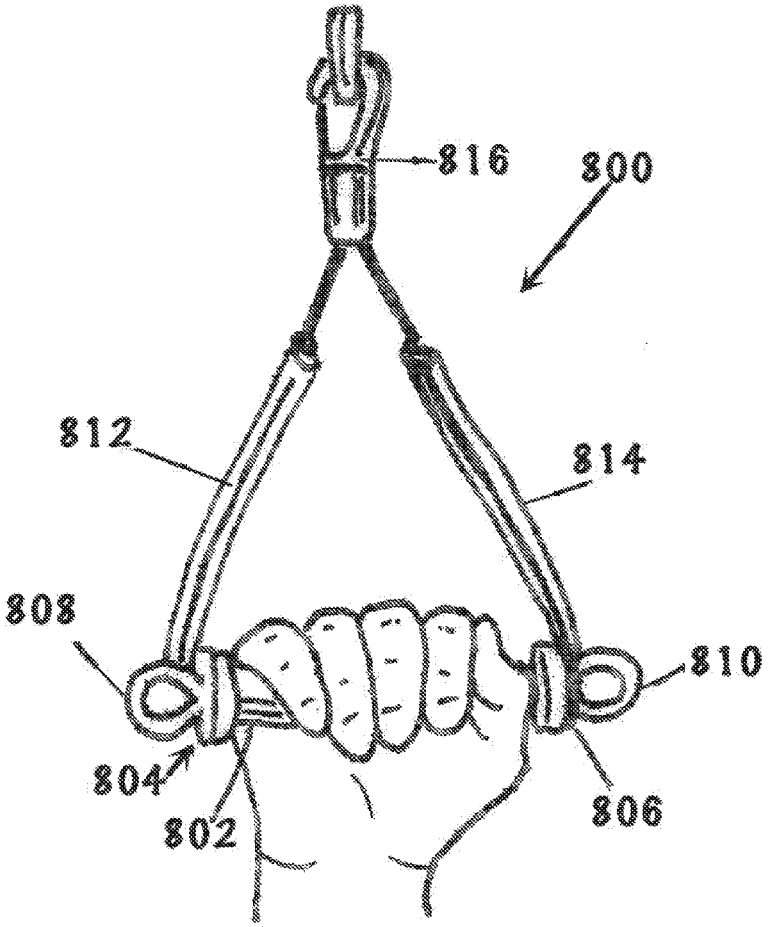
FIG. 19 is a front elevation view of a tri-latch hand grip.

FIG. 19 depicts a tri-latch hand grip 800 that is useful in certain exercise systems and methods. As used herein, the term "tri-latch hand grip" refers to a hand grip that comprises a grip handle, two extension members and three latching mechanisms. The tri-latch hand grip 800 has a grip bar 802 with a first end 804 and a second end 806. A first latching mechanism 808 is operatively secured to the first end 804 and a second latching mechanism 810 is operatively secured to the second end 806 of the grip bar 802. A first extension member 812 is operatively secured to the first end 804 of the grip bar and a second extension member 814 is operatively secured to the second end 806 of the grip bar 802. The first extension member 812 and the second extension member 814 are operatively secured to a third latching mechanism 816. In the embodiment of FIG. 4 the first latching mechanism and the second latching mechanisms are eye hooks and the third latching mechanism is a clip. In other embodiments different combinations of latching mechanisms may be used.

Figure 20A:
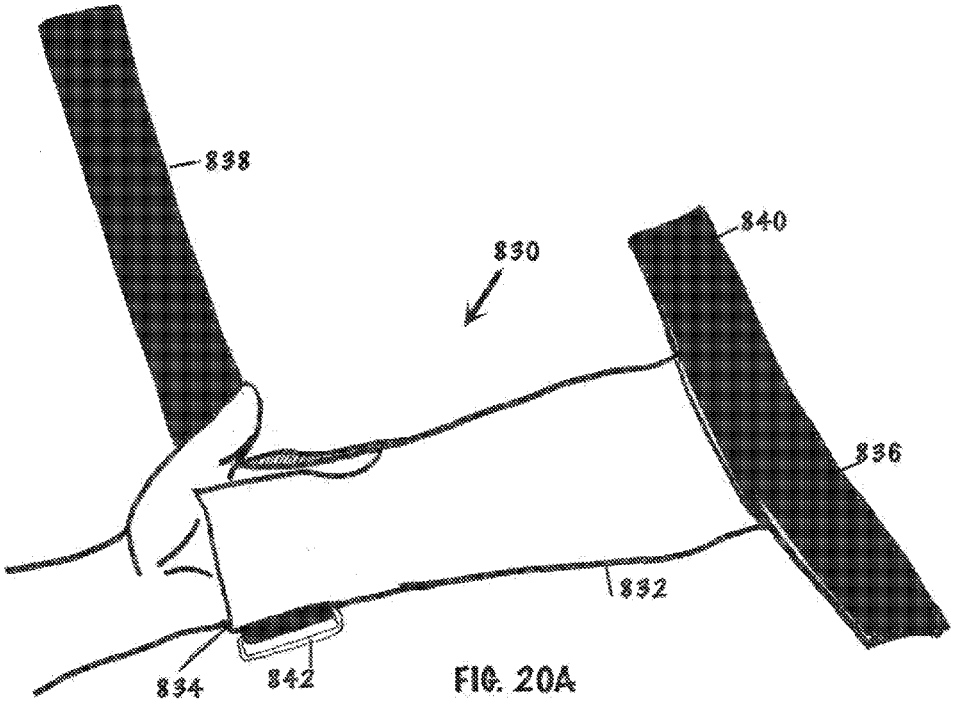
FIGS. 20A-20H are perspective illustrations of a buckle strap soft hand grip.
Figure 20B:
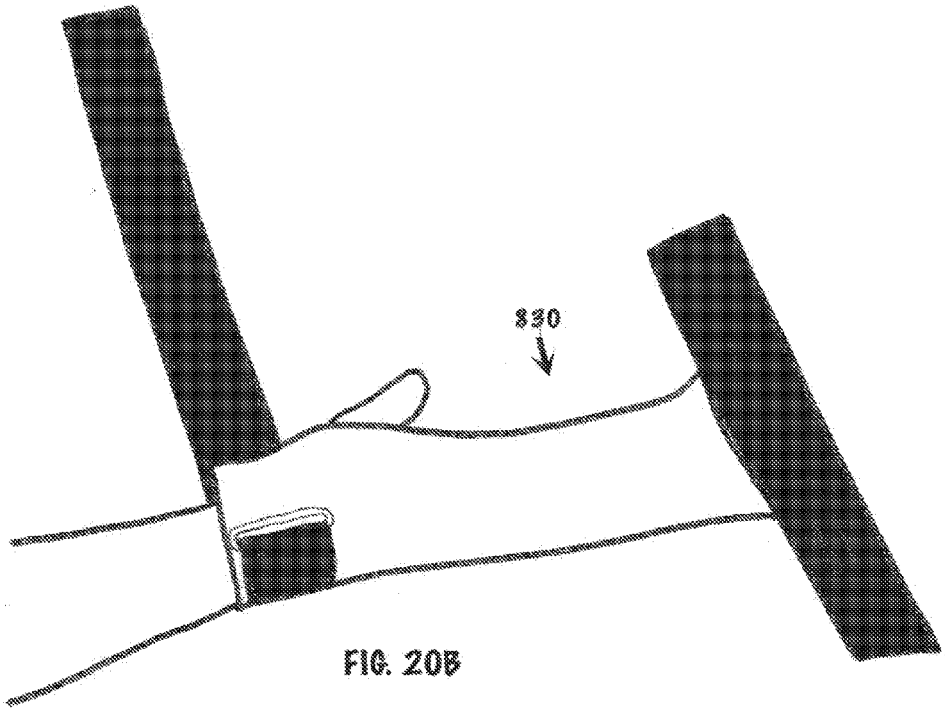
Figure 20C:
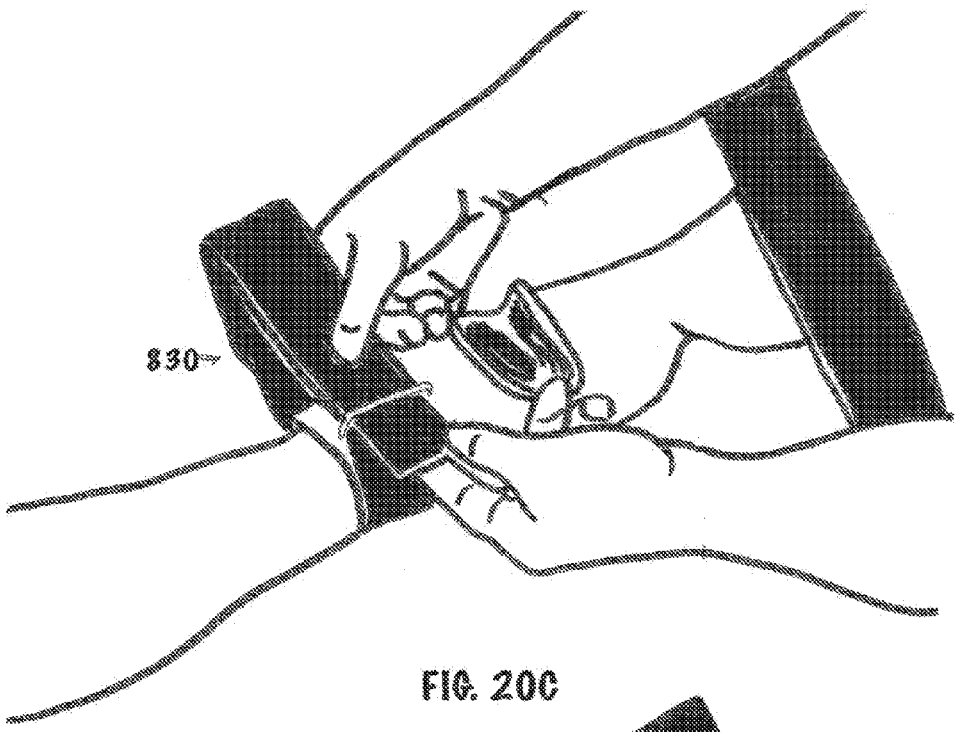
Figure 20D:
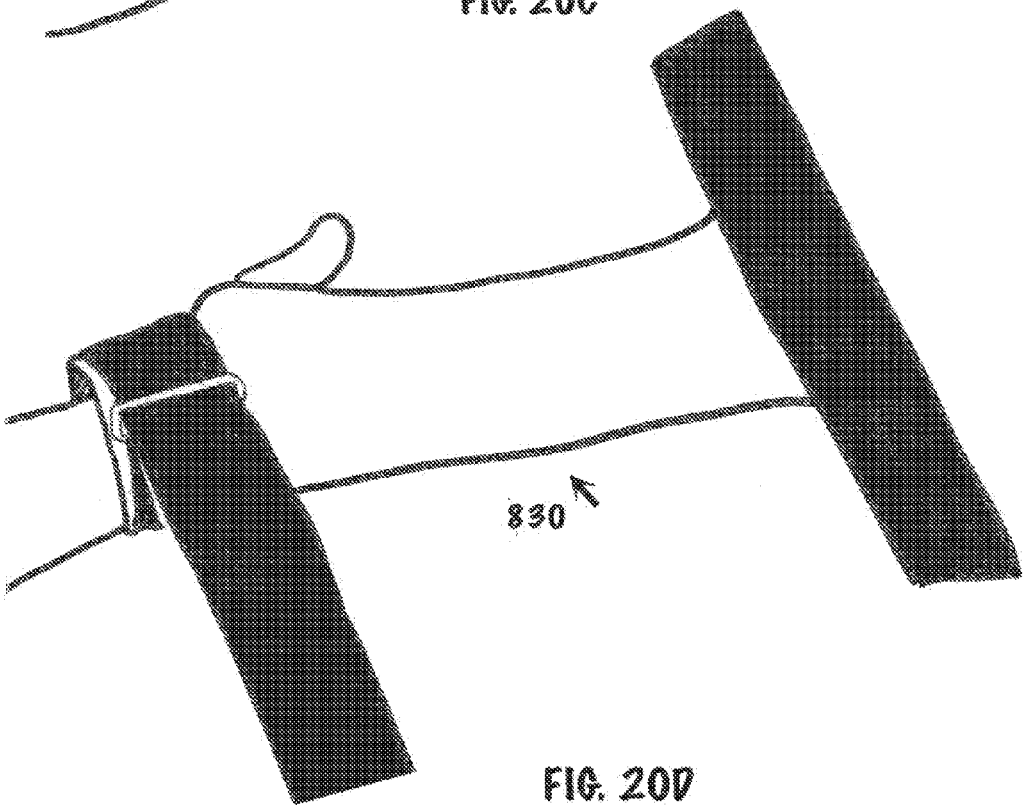
Figure 20E:
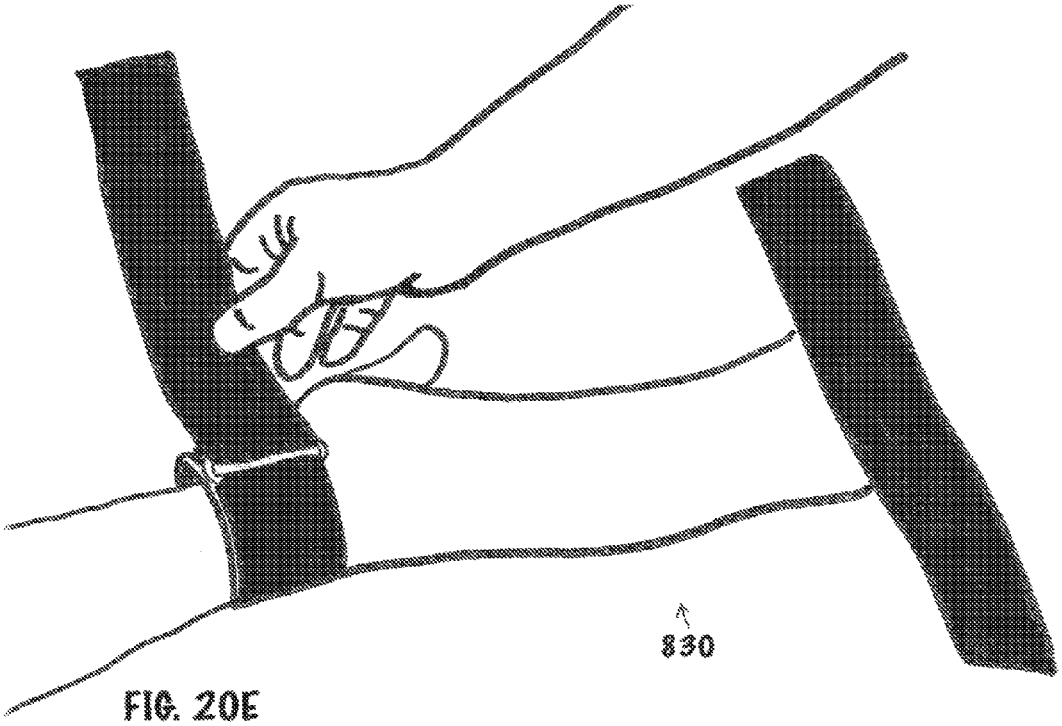
Figure 20F:
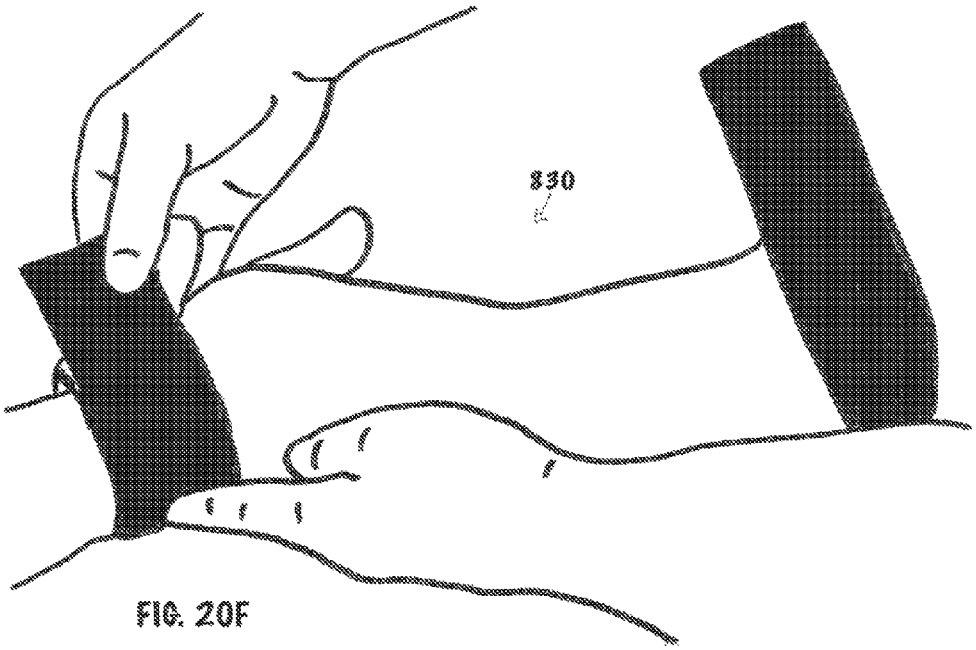
Figure 20G:
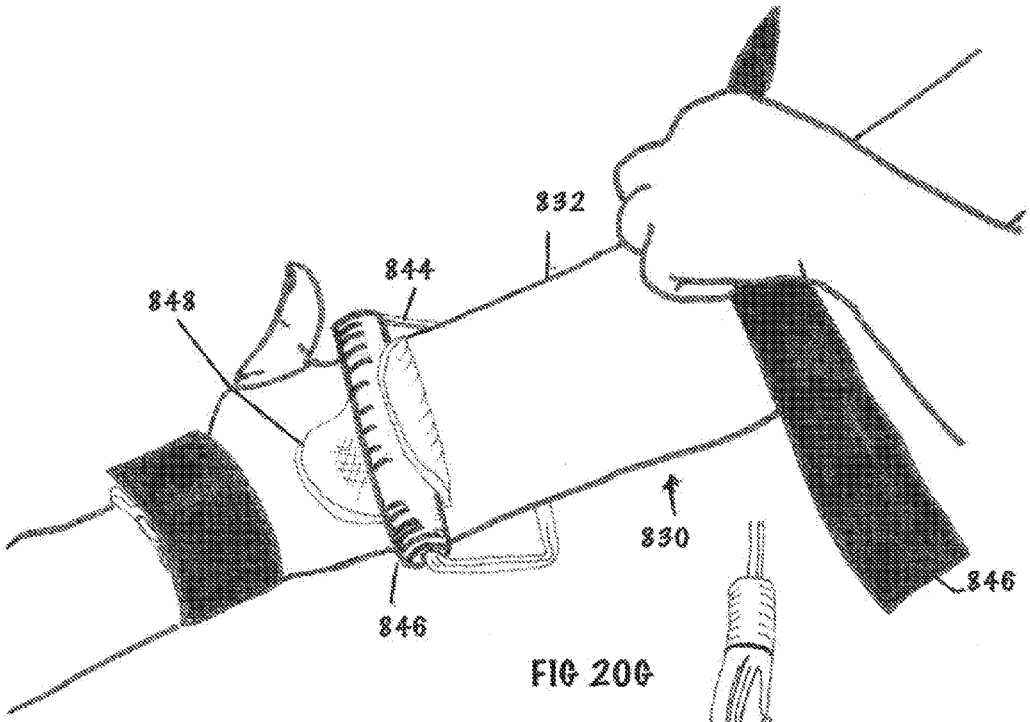
Figure 20H:
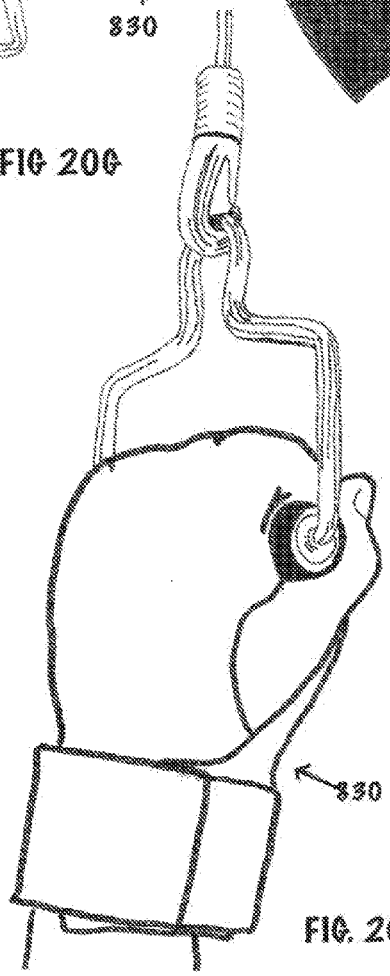

FIGS. 20A-20H depict a buckle strap soft handgrip 830. As used herein, the term "buckle strap soft handgrip" refers to a hand grip that includes a mitten having a first and second edge, a first hook-and-loop fastener strap operatively secured adjacent the first edge and a second hook-and-loop fastener strap operatively secured adjacent the second edge, a buckle loop operatively secured to the mitten adjacent the first edge, and a hand grip with a grip handle where the first hook-and-loop fastener strap is configured to pass through the buckle loop to secure the first hook-and-loop fastener strap to a person's wrist, the mitten is configured to wrap around the grip handle, and the second hook-and-loop fastener strap is configured to wrap around the person's wrist. FIGS. 20A-20H illustrate how the buckle strap soft handgrip is attached to a person's hand. As seen in FIG. 20A, the buckle strap handgrip 830 has a mitten 832 having a first edge 834 and second edge 836. The person inserts his or her hand in the mitten. There is a first hook-and-loop fastener strap 838 that is operatively secured adjacent the first edge 834 and a second hook-and-loop fastener strap 840 that is operatively secured adjacent the second edge 836. There is a buckle loop 842 that is operatively secured to the mitten 832 adjacent the first edge 834. The first hook-and-loop fastener strap 838 is configured to pass through the buckle loop 842 to secure the first hook-and-loop fastener strap 838 to a person's wrist. As seen in FIG. 20G there is a handgrip 844 with a grip handle 846. In this embodiment there is a gripper 848 that has hook-and-loop fastening functionality with the mitten 832. The gripper 848 helps secure the grip handle 846 in the buckle strap soft handgrip 830. The mitten 832 is configured to wrap around the grip handle 846, and the second hook-and-loop fastener strap 846 is configured to wrap around the person's wrist as seen in FIG. 20H.

Figure 21:
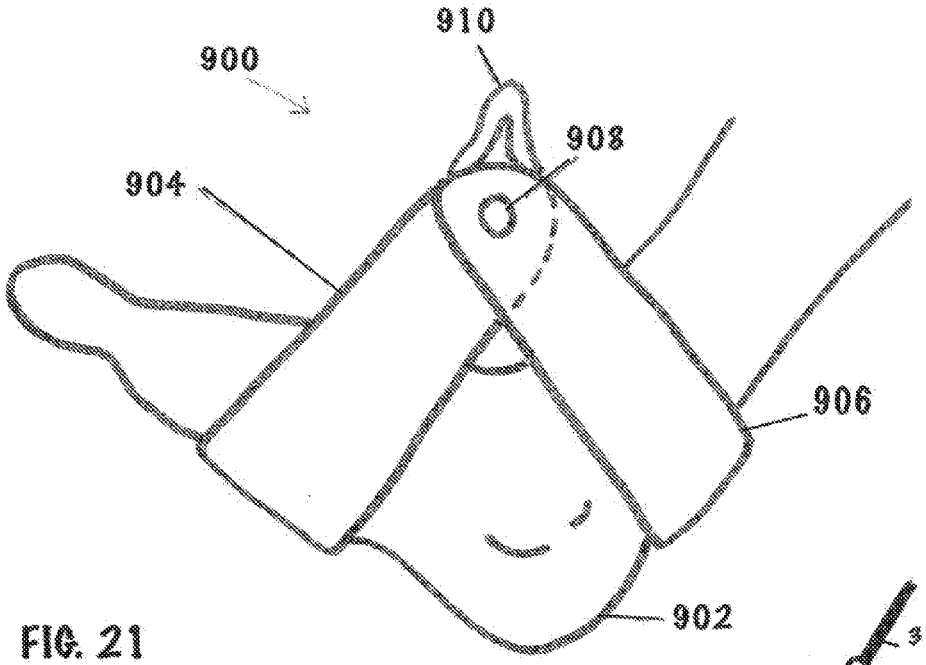
FIG. 21 is a side elevation view of a dual-strap foot cradle.

FIG. 21 illustrates a dual-strap foot cradle 900 that is useful in certain passive and active exercise systems and methods. As used herein, the term "dual-strap foot cradle" refers to a foot cradle comprising two conjoined flexible straps, one flexible strap configured to pass under the sole of a person's foot and the second flexible strap configured to pass behind the person's Achilles tendon. The dual-strap foot cradle supports a person's foot 902 with a first flexible strap 904 that passes under the sole of the person's foot and a second flexible strap 906 that passes behind the person's Achilles tendon. The first flexible strap 904 and the second flexible strap 906 are conjoined with an attachment article 908. The attachment article 908 typically comprises an eyelet, but may alternately comprise a loop 910 stitched to the first flexible strap 904 and the second flexible strap 906, or a similar structure.

Figure 22A:
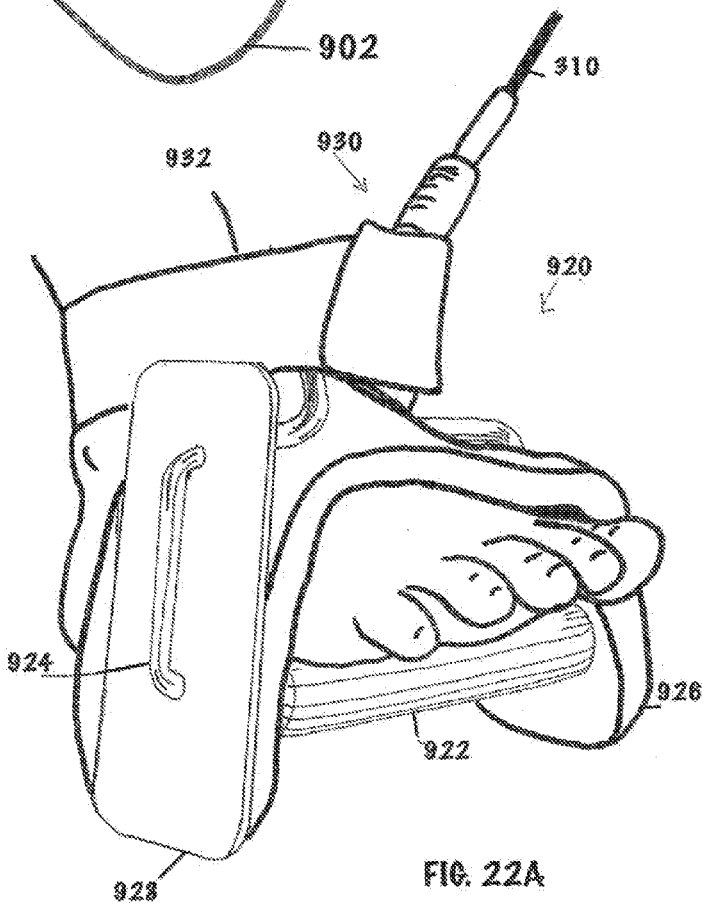
FIGS. 22A, 22B, and 22C are perspective views of a shielded stirrup.
Figure 22B:
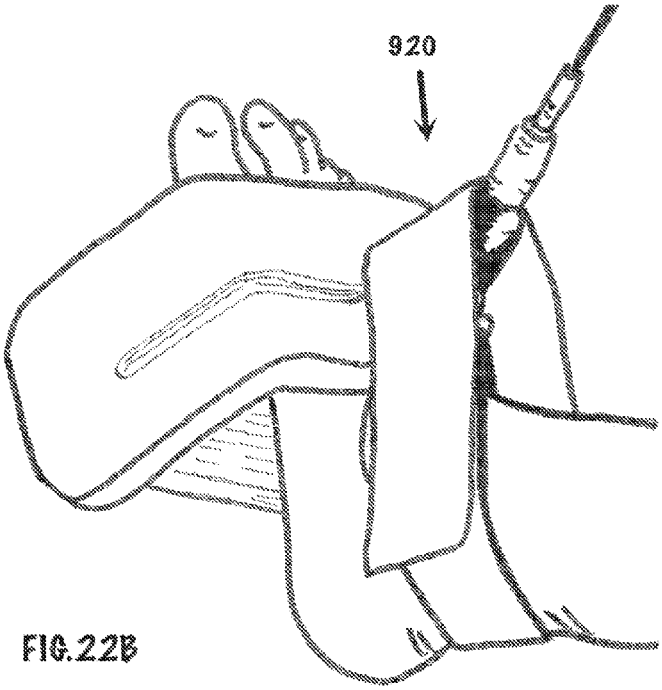
Figure 22C:
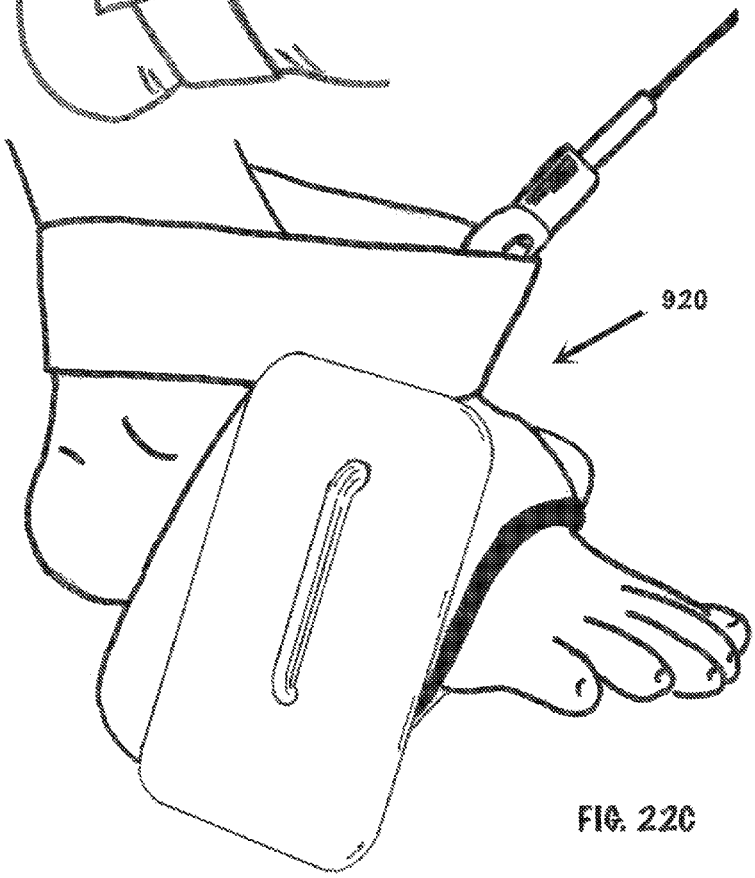

FIGS. 22A, 22B, and 22C illustrate a shielded stirrup 920. As used herein, the term "shielded stirrup" refers to a foot cradle comprising (a) a foot support, (b) a stirrup brace configured to hold the foot support in a position, wherein a person may rest a foot on the foot support between the foot support and the stirrup brace, (c) a pad disposed to protect the top of the person's foot from abrasion from the stirrup brace, and (d) a semi-stiff plate disposed between the pad and the stirrup brace to protect the person's foot from abrasion due to the stirrup brace. As seen in FIGS. 22A, 22B, and 22C, the shielded stirrup 920 has a foot support 922, a stirrup brace 924, a pad 926, and a semi-stiff plate 928. The shielded stirrup 920 also has an attachment point 930 for securing the shielded stirrup 920 to an exercise apparatus. In most embodiments the shielded stirrup 920 may be operatively secured to the rotary drive mechanism. In some embodiments the shielded stirrup 920 is connected directly to the rotary drive mechanism 200 (FIG. 3) and in some embodiments the shielded stirrup 920 is operatively secured to the rotary drive mechanism 200 through a cord (e.g., left cord 310 of FIG. 1) and one or more pulleys (e.g. third left pulley 380 of FIG. 1) and one or more hooks (e.g., L-H5, L-H6 or L-H7 of FIG. 1) that connect the shielded stirrup 920 to the rotary drive mechanism 200. In the embodiment of FIGS. 22A, 22B, and 22C, the shielded stirrup 920 includes a hook-and-loop fastened strap 932 that circumscribes the back of the person's foot and the attachment point 930.

Figure 23A:
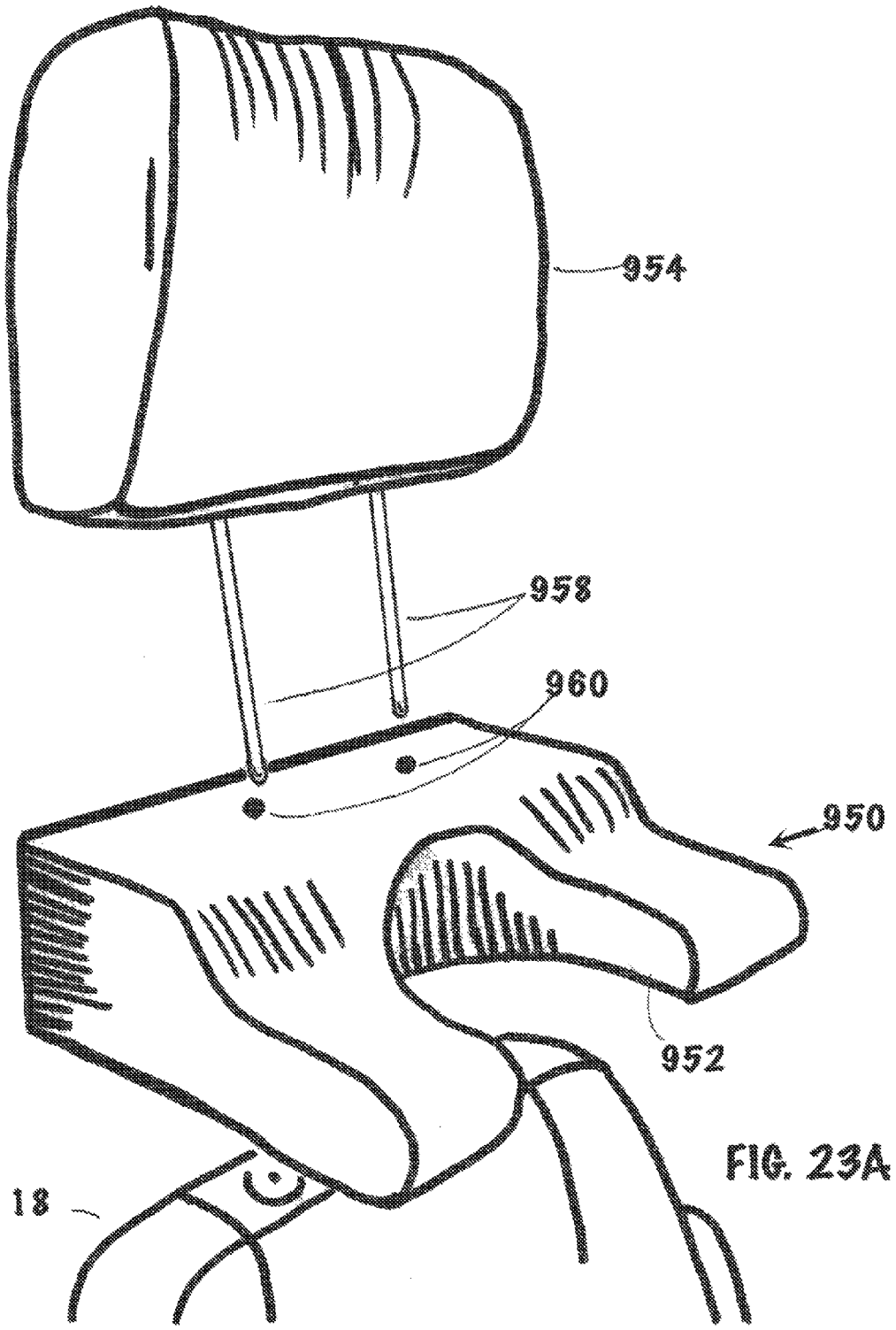
FIGS. 23A, 23B, and 23C are perspective views of a head support.
Figure 23B:
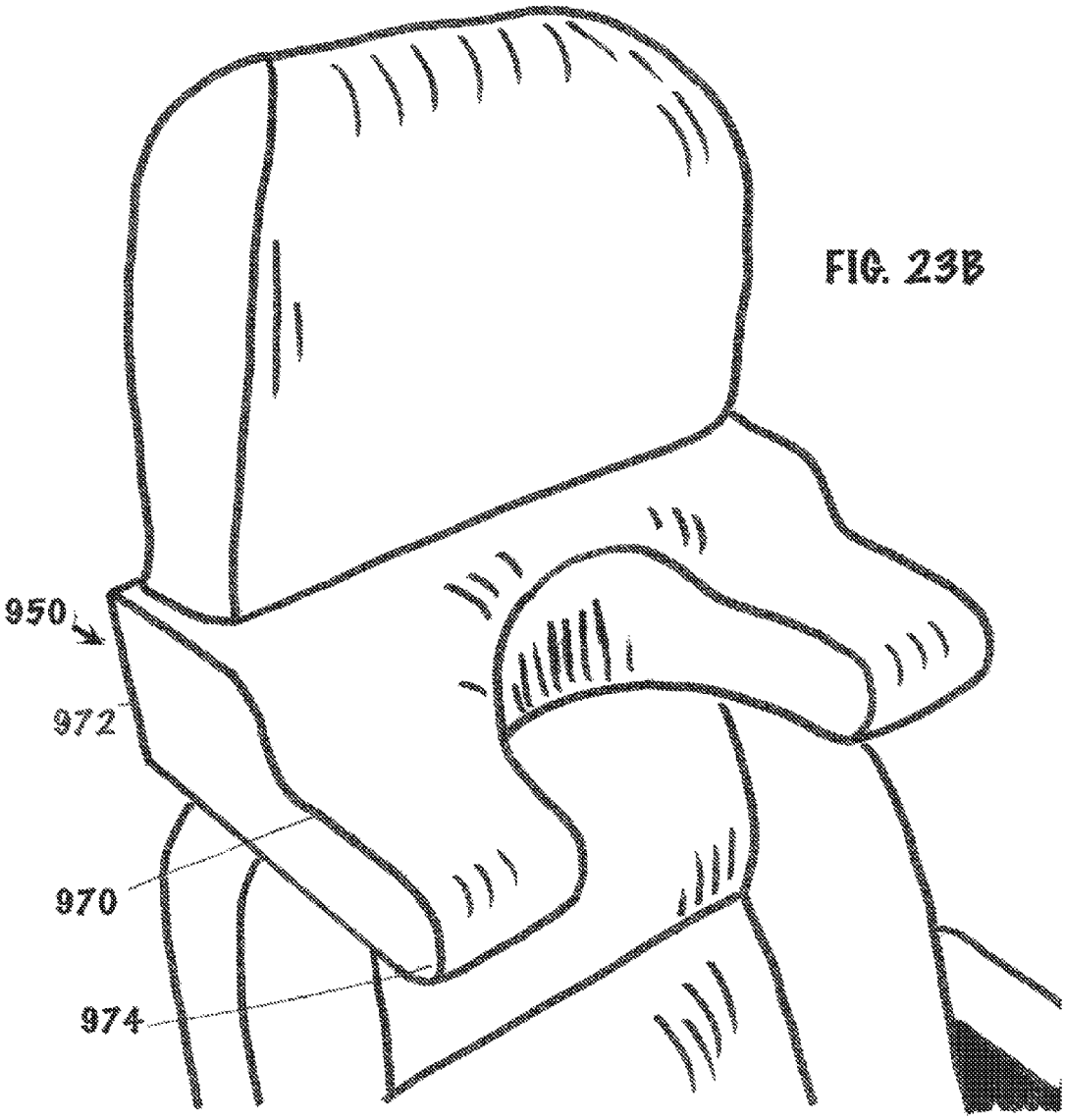
Figure 23C:
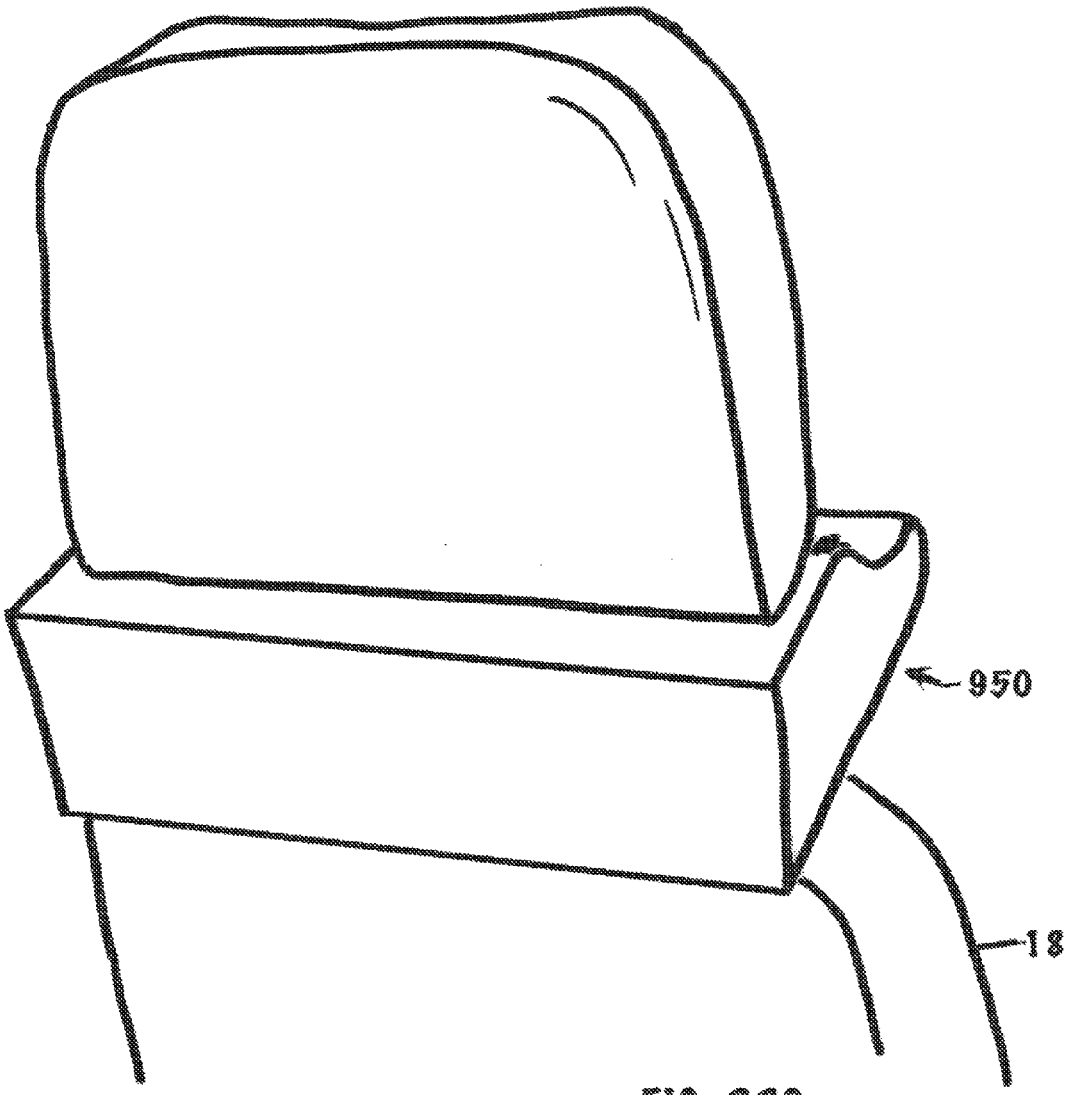

FIGS. 23A, 23B, and 23C illustrate a head support 950. As used herein, a "head support" refers to a cushion that may be used by a person using an exercise apparatus, where the cushion has a concave portion that fits around the back of the person's head or neck and wherein at least a portion of the head support is configured to be positioned to between the headrest and backrest of a seat that are operatively secured to each other by at least one prong, and wherein the head support is configured to be operatively secured to the backrest by at least one prong. FIG. 23A illustrates a head support 950 having a concave portion 952. A person using the head support places the back of their head or neck in the concave portion 952 of the head support 950 with their face looking outward. As seen in FIG. 23A, the head support 950 is configured to be positioned between a headrest 954 and a backrest 18 of a seat (e.g., seat 16 depicted in FIG. 1). The headrest 954 has two prongs 958, and the head support 950 is configured with two holes 960 that pass through the head support 950, and the two prongs 958 of the headrest 954 are typically inserted through the two holes 960 in the head support 950 into matching holes in the backrest 18 such that the head support 950 is operatively secured to the backrest 18 of the seat. In some embodiments the headrest 954 may have only one prong (which may be a flat blade) and in such embodiments the head support 950 is held in place by the one prong. In the embodiment of FIGS. 23A, 23B, and 23C, the head support 950 has a tapered section 970 that tapers the thickness of the head support 950 from a thicker region proximal to the back 972 of the head support 950 to a thinner region proximal to the front 974 of the head support 950. FIG. 23C depicts the head support 950 as viewed from the back of the backrest 18.

In some embodiments it is desirable to maintain a person's leg in a substantially straight position. In such embodiments a splint or a brace may be applied to a person's knee to assist in maintaining the straight position. Alternately an individual may assist a person using an exercise apparatus to maintain a straight knee position. As used herein the terms "assist" and "assisting" refer to actions to aid a person using an exercise apparatus, ranging from instructing the person in what to do, to coaching the person for better performance, to physically intervening and either manually or with performance aids helping the person perform the exercise in a prescribed manner.

The term "therapeutic exercise enhancement device" is used herein to refer to a tri-latch handgrip, or to a buckle strap soft handgrip, or to a dual-strap foot cradle, or to a shielded stirrup, or to a head support, or to a splint, or to a brace.

Figure 24:
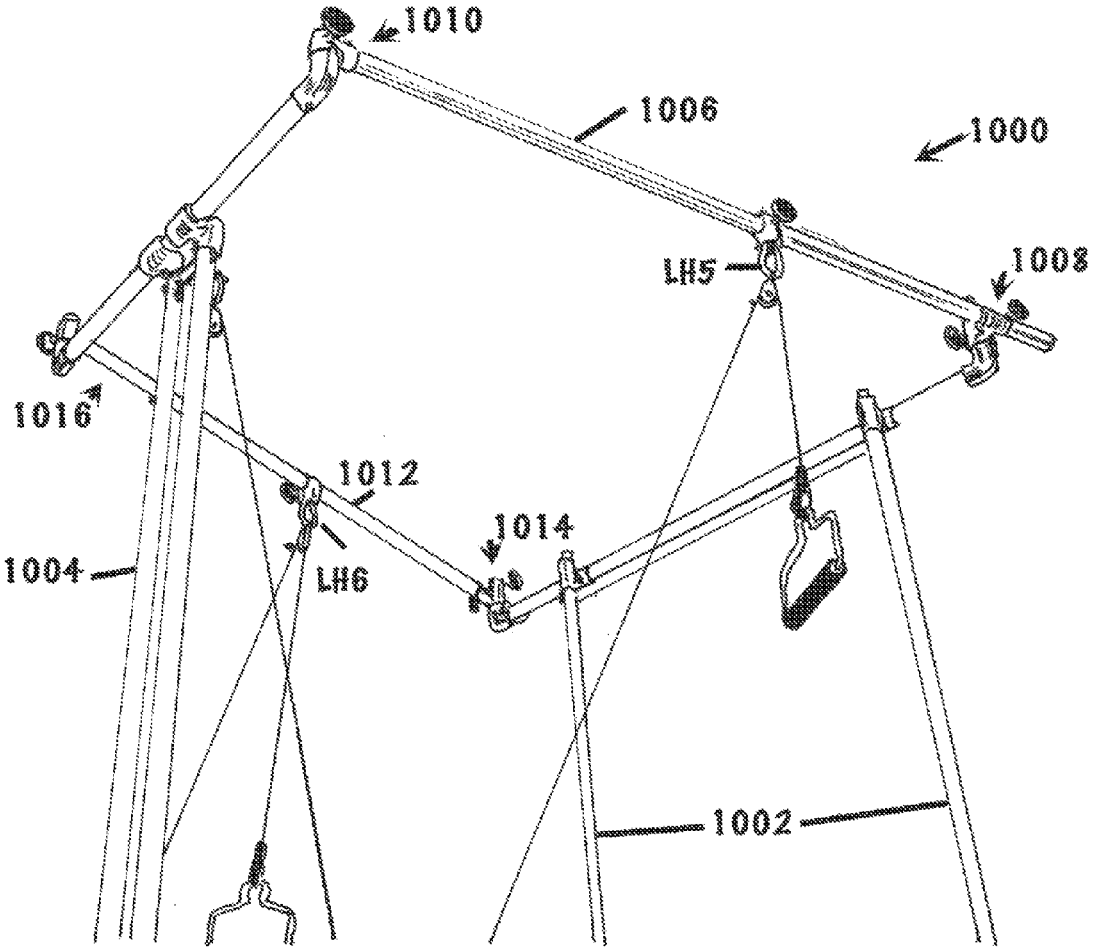
FIG. 24 is a view of an exercise apparatus having a lateral extension configuration, looking upward from a position just in front and to the left of the apparatus.

FIG. 24 illustrates a portion of an exercise apparatus 1000. Like the exercise apparatus 10 depicted in FIGS. 1 and 2, the exercise apparatus 1000 has a frame structure with a base member configured to support the seat having a seat width and a plurality of forward and backward positions and a backrest with a backrest width; having a lateral extension configuration. FIG. 24 shows a view of the exercise apparatus 1000 looking upward from a position just in front and to the left of the apparatus. There is a rear vertical riser system 1002 and a forward vertical riser system 1004. There is a transverse top left brace system 1006 having a rear portion 1008 operatively secured to the rear vertical riser system 1002 and a forward portion 1010 that is operatively secured to the forward vertical riser system. 1004.

The exercise apparatus 1000 has a transverse top right brace system 1012 having a rear portion 1014 that is operatively secured to the rear vertical riser system 1002 and a forward portion 1016 that is operatively secured to the forward vertical riser system 1004. In the embodiment of FIG. 24, the transverse top left brace system 1006 and the transverse top right brace system 1012 are disposed in a configuration wherein at least a portion of the forward portion 1010 of the transverse top left brace system 1006 and at least a portion of the forward portion 1016 of the transverse top right brace system 1012 are spaced apart a distance approximately greater than the seat width. This permits the L-H5 hook and the R-H5 hook to be positioned further way from the person, thereby extending the range of motion that may be achieve using the exercise apparatus 1000 of FIG. 24 compared with the exercise apparatus 10 of FIGS. 1 and 2.

Figure 25:
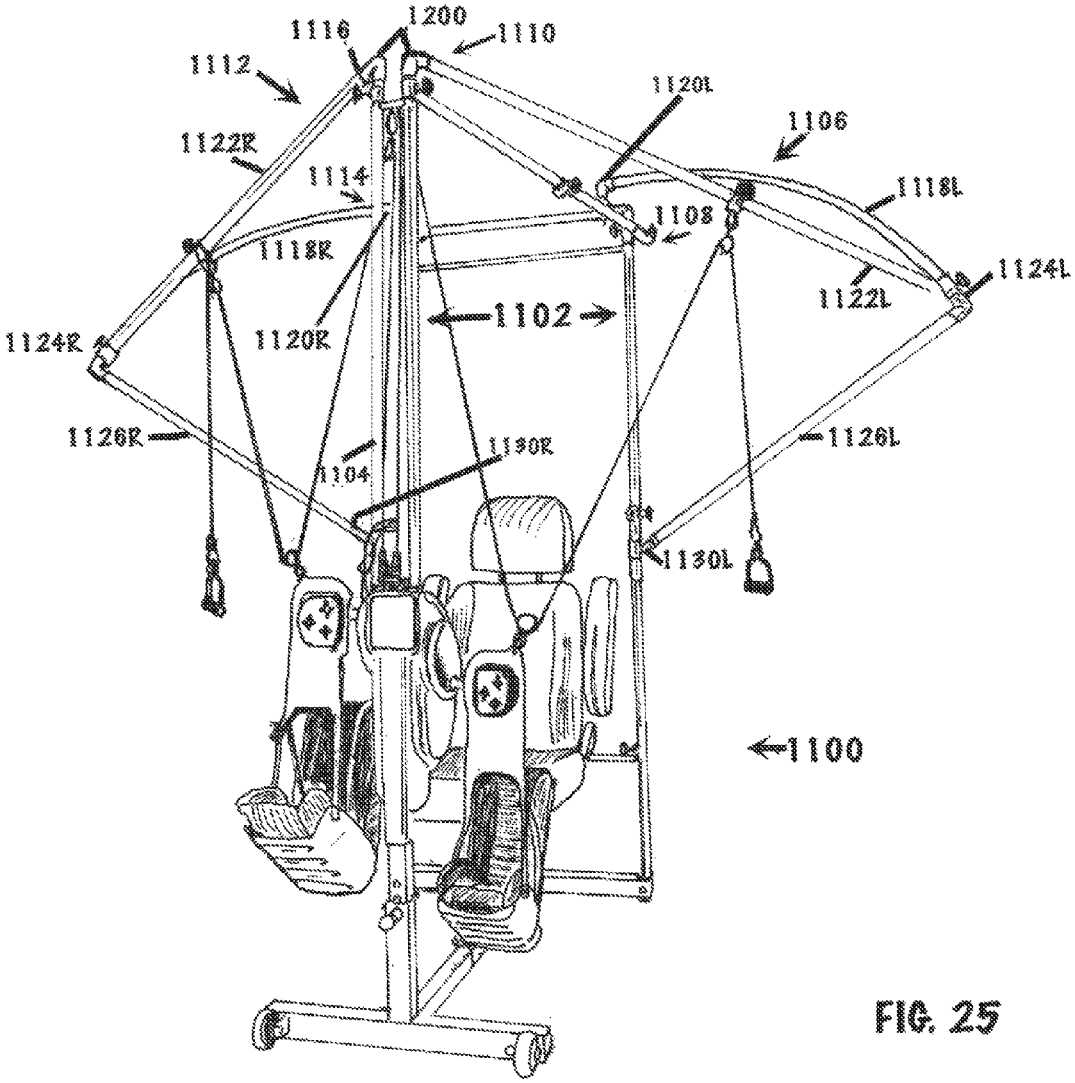
FIG. 25 is a generally front perspective view of an exercise apparatus having a lateral extension configuration.

FIG. 25 illustrates a portion of an exercise apparatus 1100. Like the exercise apparatus 10 depicted in FIGS. 1 and 2, the exercise apparatus 1100 has a frame structure with a base member configured to support the seat having a seat width and a plurality of forward and backward positions and a backrest. The exercise apparatus 1100 has a rear vertical riser system 1102 and a forward vertical riser system 1104. There is a transverse top left brace system 1006 having a rear portion 1108 that is operatively secured to the rear vertical riser system 1102 and a forward portion 1110 that is operatively secured to the forward vertical riser system 1104 by flexible joints 1200.

The exercise apparatus 1100 has a transverse top right brace system 1112 having a rear portion 1114 that is operatively secured to the rear vertical riser system 1102 and a forward portion 1116 that is operatively secured to the forward vertical riser system 1104 by a flexible joint 1200. In the embodiment of FIG. 25, the transverse top left brace system 1106 and the transverse top right brace system 1112 are disposed in a configuration where the transverse top left brace system 1106 and the transverse top right brace system 1112 each include an arched member, 1118L and 1118R respectively, that is operatively secured to the rear vertical riser system 1102 by a pivot hinge 1120L and 1120R respectively. The transverse top left brace system 1106 and the transverse top right brace system 1112 each also include a swing member, 1122L and 1122R respectively, that is operatively secured to the forward vertical riser system 1104 and to its respective arched member 1118L and 1118R by an adjustable slide fastener 1124L and 1124R respectively. The transverse top left brace system 1106 and the transverse top right brace system 1112 each include a support member 1126L and 1126R respectively that is operatively secured to the rear vertical riser system 1102 with a swivel hinges 1130L and 1130R respectively. As the adjustable slide fasteners 1124L and 1124R are moved up and down the arched members 1118L and 1118R respectively, the arched members 1118L and 1118R and the support members 1126L and 1126R swing on the pivot hinges 1120L and 1120R and the swivel hinges 1130L and 1130R. This permits the L-H5 hook and the R-H5 hook to be positioned further way from the person, thereby extending the range of motion that may be achieved using the exercise apparatus 1100 of FIG. 25 compared with the exercise apparatus 10 of FIGS. 1 and 2.

Figure 26A:
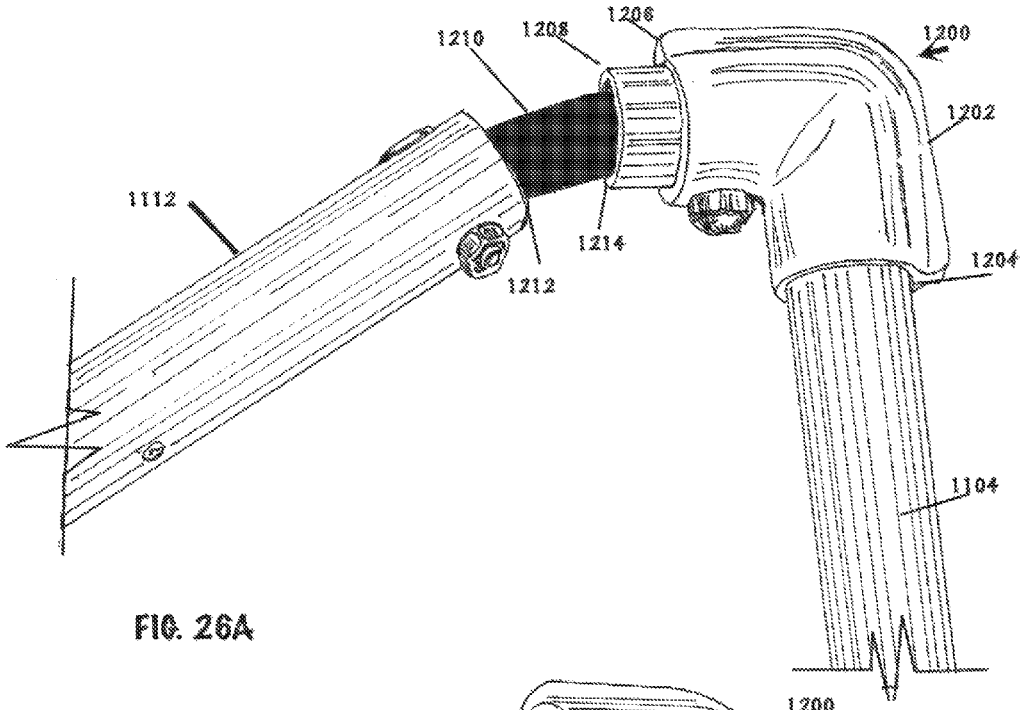
FIGS. 26A and 26B are perspective illustrations of flexible joints.
Figure 26B:
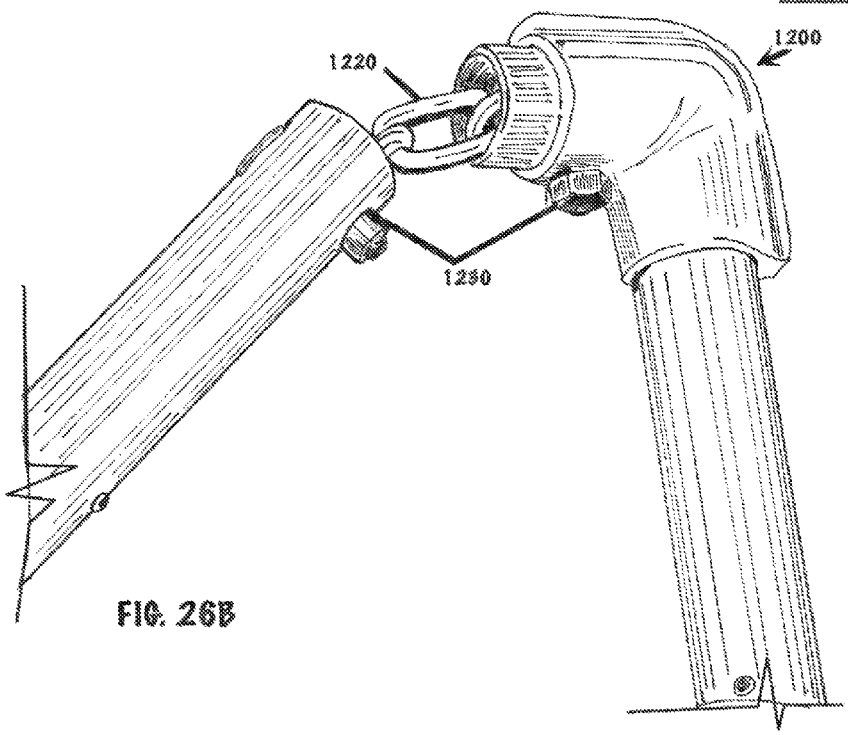

FIGS. 26A and 26B depict details of a flexible joint 1200. The flexible joint 1200 depicted in FIGS. 26A and 26B operatively secures the transverse top right brace system 1112 (only a portion of which is shown in FIGS. 26A and 26B) to the forward vertical riser system 1104 only a portion of which is shown in FIGS. 26A and 26B). The flexible joint 12 includes an elbow 1202 having a first connection port 1204 and a second connection port 1206. The forward vertical riser system 1104 is operatively secured to the first connection port 1204. An extension 1208 is operatively secured to the second connection port. There is a flexible tube 1210 that operatively secures a first coupled member (in this case the extension 1208) to a second coupled member (in this case the transverse top right brace system 1112). In the embodiment of FIGS. 26A and 26B, the flexible tube 1210 stops at the elbow 1202. In some embodiments the flexible tube 1210 is shortened so that at least a portion of an interface surface 112 of the transverse top right brace system 1112 is in physical contact with at least a portion of an interface surface 1214 of the extension 1208. In FIG. 26B the flexible tube 1210 has been cut away between the extension 1208 and the transverse top right brace system 1112 to reveal a chain 1220 that is disposed within the flexible tube 1210. Two bolt assemblies 1230 are used to secure the chain 1220 and the flexible tube 1220 to the transverse top right brace system 1112 and the elbow 1202 respectively.

Figure 27A:
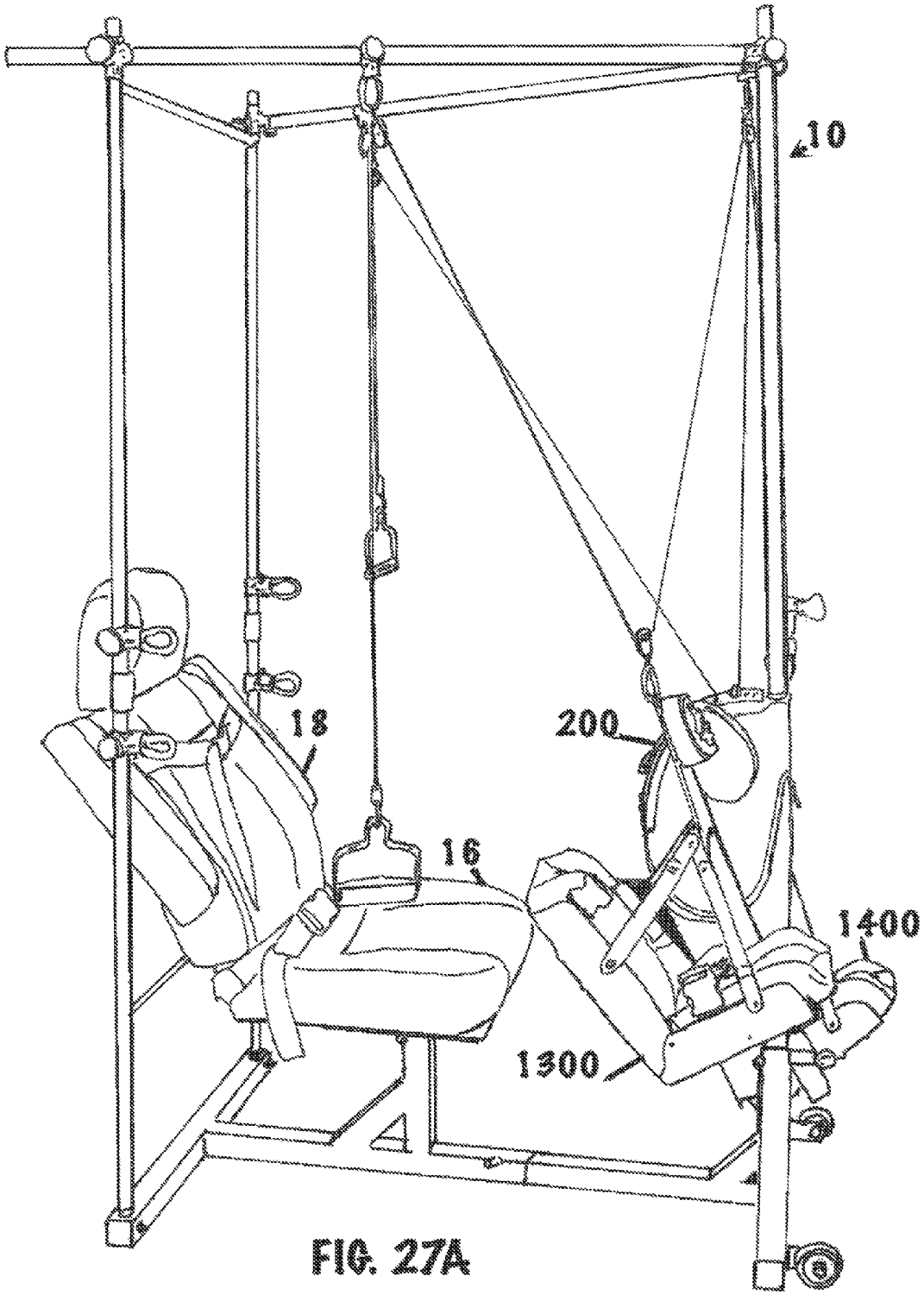
FIG. 27A is a perspective illustration of an exercise apparatus.
Figures 27B, 27C, 27D:
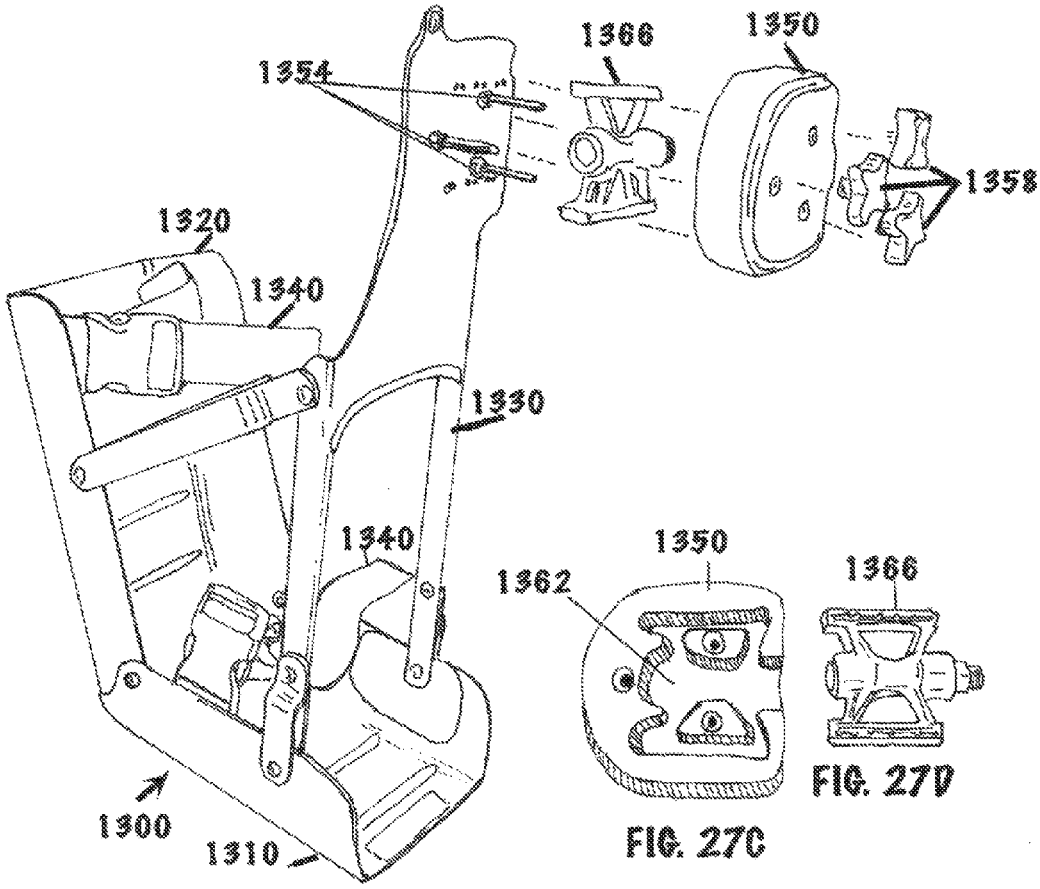
FIG. 27B is a perspective illustration of a reversible foot cradle.
FIG. 27C. is a bottom view of a reversible pedal.
FIG. 27D is a top view of a pedal axel.

FIG. 27A depicts an exercise apparatus 10 that includes the previously described seat 16, backrest 18 and rotary drive mechanism 200. The exercise apparatus 10 further includes a first asymmetrical reversible foot cradle 1300 and a second asymmetrical reversible foot cradle 1400. FIG. 27B depicts details of the first asymmetrical reversible foot cradle 1300. The first asymmetrical reversible foot cradle 1300 includes a foot support 1310, a calf support 1320 and a support bracket 1330. A persons foot is positioned in the foot cradle and two belt straps 1340 may be used to secure the person's foot in the foot cradle 1300. A pedal 1350 is operatively secured to the support bracket 1330 by a set of threaded fasteners 1354 and knobs 1358. A further illustration of the pedal 1350 is presented in FIG. 27C where a recessed portion 1362 is depicted. FIG. 27D depicts an axel assembly 1366 that fits into the recessed portion 1362 of the pedal 1350. The second asymmetrical reversible foot cradle 1400 is substantially a mirror-image of the first asymmetrical reversible foot cradle. A first and second mating surface is provided on the rotary drive mechanism 200 to operatively secure the first asymmetrical reversible foot cradle 1300 and the second asymmetrical reversible foot cradle 1400 to the rotary drive mechanism.

In some embodiments the first asymmetrical reversible foot cradle 1300 of FIG. 27B is assembled operatively secured to the rotary drive mechanism 200 as shown in FIG. 27A. That is, the first asymmetrical reversible foot cradle 1330 is disposed adjacent the right side of the rotary drive mechanism 200 (as viewed from the seat 16), and in such embodiments the second asymmetrical reversible foot cradle 1400 is disposed adjacent the left side of the rotary drive mechanism 200 (as viewed from the seat 16). In such embodiments, each foot support (e.g., the foot support 1310) faces toward the seat 16 and the backrest 18.

In further embodiments the first asymmetrical reversible foot cradle 1300 of FIG. 27B may be assembled adjacent the left side of the rotary drive mechanism 200 (as viewed from the seat 16) and the second asymmetrical reversible foot cradle 1400 is assembled adjacent the right side of the rotary drive mechanism 200 (as viewed from the seat 16). The first asymmetrical reversible foot cradle 1300 and the second asymmetrical reversible foot cradle are asymmetric, so that in such further embodiments the each foot support (e.g., the foot support 1310) faces away from the seat 16 and the backrest 18. These further embodiments permit the use of the exercise apparatus 10 by a person seated distal from the seat 16, such as the use by a person in a wheelchair. As used herein the term "asymmetric reversible foot cradle" refers to a foot cradle that may be positioned either facing toward the seat or facing away from the seat of an exercise apparatus. The first asymmetrical reversible foot cradle 1300 and the second asymmetrical reversible foot cradle 1400 each have two asymmetrical functional spatial orientations. That is, the rotary drive mechanism 200 provides two mating mounting structures (one on the right side of the rotary drive mechanism 200 and one on the left side of the rotary drive mechanism 200) for the axel assembly 1366.

The two mating mounting surfaces on the rotary drive mechanism may be used to operatively secure the first asymmetrical reversible foot cradle 1300 in either of two asymmetrical functional spatial orientations, one orientation facing toward the seat 16 (as shown in FIG. 27A) and one orientation facing away from the seat 16. The reversible foot cradles and their orientations are "asymmetrical" because (1) the first asymmetrical reversible foot cradle 1300 may not be assembled adjacent the right side of the rotary drive mechanism 200 (as viewed from the seat 16) without orienting the foot support 1310 of the first asymmetrical reversible foot cradle to face toward the seat 16, and the second asymmetrical reversible foot cradle 1400 may not be assembled adjacent the left side of the rotary drive mechanism 200 (as viewed from the seat 16) without the foot support of the second asymmetrical reversible foot cradle 1400 facing toward the seat 16, and (2) the first asymmetrical reversible foot cradle 1300 may not be assembled adjacent the left side of the rotary drive mechanism 200 (as viewed from the seat 16) without orienting the foot support 1310 of the first asymmetrical reversible foot cradle 1300 to face away from the seat 16, and the second asymmetrical reversible foot cradle 1400 may not be assembled adjacent the right side of the rotary drive mechanism 200 (as viewed from the seat 16) without the foot support of the second asymmetrical reversible foot cradle 1400 facing away from the seat 16. In other words, the first asymmetrical reversible foot cradle 1300 has two asymmetrical functional spatial orientations with respect to the two mating mounting surfaces on the exercise apparatus 10.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

The invention claimed is:

1. An exercise apparatus comprising:

a frame structure with a base member configured to support a seat with a plurality of forward and backward positions and with a backrest;

a rear vertical riser system operatively secured to the base member;

a forward vertical riser system operatively secured to the base member;

a transverse top left brace operatively secured to the rear vertical riser system and to the forward vertical riser system;

a transverse top right brace operatively secured to the rear vertical riser system and to the forward vertical riser system;

a rotary drive mechanism configured to move a left rotary attachment and a right rotary attachment; and a therapeutic exercise enhancement device selected from the group consisting of (a) a dual-strap foot cradle operatively secured to the left rotary attachment or to the right rotary attachment, (b) a shielded stirrup operatively secured to the left rotary attachment or to the right rotary attachment, (c) a cord operatively secured to the left rotary attachment or to the right rotary attachment and secured to the transverse top left brace or to the transverse top right brace, and a tri-latch hand grip operatively secured to the cord, (d) a buckle strap soft hand grip, (e) a head support disposed on the backrest, (f) an asymmetrical reversible foot cradle, and (g) a combination of two or more of the dual-strap foot cradle, the shielded stirrup, the cord and tri-latch hand grip, the buckle strap soft hand grip, the head support and the asymmetrical reversible foot cradle.

2. The exercise apparatus of claim 1 wherein the therapeutic exercise enhancement device comprises the dual-strap foot cradle operatively secured to the left rotary attachment or to the right rotary attachment.

3. The exercise apparatus of claim 1 wherein the therapeutic exercise enhancement device comprises the shielded stirrup operatively secured to the left rotary attachment or to the right rotary attachment.

4. The exercise apparatus of claim 1 wherein the therapeutic exercise enhancement device wherein the cord is operatively secured to the left rotary attachment or to the right rotary attachment and is secured to the transverse top left brace or to the transverse top right brace, and a tri-latch hand grip is operatively secured to the cord.

5. The exercise apparatus of claim 1 wherein the therapeutic exercise enhancement device comprises the buckle strap soft hand grip.

6. The exercise apparatus of claim 1 wherein the therapeutic exercise enhancement device comprises a head support operatively secured to the backrest.

7. The exercise apparatus of claim 1 wherein the therapeutic exercise enhancement device comprises an asymmetrical reversible foot cradle.

8. An exercise apparatus comprising:

a seat having a seat width and a plurality of forward and backward positions and a backrest with a backrest width;

a frame structure with a base member configured to support the seat;

a rear vertical riser system operatively secured to the base member;

a forward vertical riser system operatively secured to the base member;

a transverse top left brace system having a rear portion operatively secured to the rear vertical riser system and a forward portion operatively secured to the forward vertical riser system; and a transverse top right brace system having a rear portion operatively secured to the rear vertical riser system and a forward portion operatively secured to the forward vertical riser system; wherein the transverse top left brace system and the transverse top right brace system are disposed in a lateral extension configuration selected from the group consisting of (a) a configuration wherein at least a portion of the forward portion of the transverse top left brace system and at least a portion of the forward portion of the transverse top right brace system are spaced apart a distance approximately greater than the seat width, (b) a configuration wherein the transverse top left brace system and the transverse top right brace system each comprise (i) an arched member operatively secured to the rear vertical riser system, (ii) a swing member operatively secured to the forward vertical riser system and to its respective arched member, and (ii) a support member operatively secured to the rear vertical riser system, and (c) a configuration wherein a first flexible joint operatively secures the transverse top left brace system to the forward vertical riser system and a second flexible joint operatively secures the transverse top right brace system to the forward vertical riser system, the first flexible joint and the second flexible joint each comprising a flexible tube and a chain.

9. The exercise apparatus of claim 8 where the lateral extension configuration comprises the configuration wherein at least a portion of the forward portion of the transverse top left brace and at least a portion of the forward portion of the transverse top right brace are spaced apart a distance approximately greater than the seat width.

10. The exercise apparatus of claim 8 where the lateral extension configuration comprises the configuration wherein the transverse top left brace system each comprise (i) an arched member operatively secured to the rear vertical riser, (ii) a swing member operatively secured to the forward vertical riser system and to the arched member, and (ii) a support member operatively secured to the rear vertical riser system.

11. The exercise apparatus of claim 8 wherein the lateral extension configuration comprises the configuration wherein a first flexible joint operatively secures the transverse top left brace system to the forward vertical riser system and a second flexible operatively secures the transverse top right brace system to the forward vertical riser system, the first flexible joint and the second flexible joint each comprising a flexible tube and a chain.

12. The exercise apparatus of claim 7 wherein the asymmetrical reversible foot cradle comprises:

a foot support;

a calf support; and a mounting structure for the foot support and the calf support, wherein the asymmetrical reversible foot cradle has two asymmetrical functional spatial orientations with respect to two mating mounting surfaces on the exercise apparatus.

* * * * *